US005440863A

United States Patent [19]

Toya et al.

[11] Patent Number: 5,440,863

[45] Date of Patent: Aug. 15, 1995

[54] BAGGER

[75] Inventors: Chiyoshi Toya, Nagoya; Tokuo Tanaka, Toyoake; Yoshinori Tanaka, Nagoya, all of Japan

[73] Assignee: Hoshizaki Denki Kabushiki Kaisha, Toyoake, Japan

[21] Appl. No.: 47,010

[22] Filed: Apr. 14, 1993

Related U.S. Application Data

[63] Continuation of Ser. No. 852,065, Mar. 16, 1992, abandoned.

[30] Foreign Application Priority Data

| | | | |
|---|---|---|---|
| Jun. 14, 1991 | [JP] | Japan | 3-170473 |
| Jul. 8, 1991 | [JP] | Japan | 3-194811 |
| Mar. 9, 1992 | [JP] | Japan | 4-050920 |

[51] Int. Cl.[6] ..... R65B 43/44

[52] U.S. Cl. ..... 53/571; 53/284.7; 53/502; 53/572; 53/573

[58] Field of Search ..... 53/284.7, 384.1, 502, 53/571, 572, 573

[56] References Cited

U.S. PATENT DOCUMENTS

| | | | |
|---|---|---|---|
| 1,800,657 | 4/1931 | Pelletier . | |
| 2,973,612 | 3/1961 | McGowan | 53/573 X |
| 3,075,324 | 1/1963 | Burks et al. | 53/572 X |
| 3,715,858 | 2/1973 | Durant et al. | 53/573 |
| 3,789,570 | 2/1974 | Mullins, Jr. | 53/572 X |
| 3,889,449 | 6/1975 | Membrino | 53/572 |
| 4,132,049 | 1/1979 | Mullins, Jr. | 53/572 X |
| 4,235,067 | 11/1980 | Parsons | 53/502 |
| 4,245,944 | 1/1981 | van Ginkel et al. | 53/384.1 X |
| 4,253,292 | 3/1981 | Lipes | 53/502 |
| 4,291,517 | 9/1981 | Lipes | 53/384.1 X |
| 4,368,608 | 1/1983 | Ray | 53/572 X |
| 4,370,845 | 2/1983 | Perolls et al. | 53/573 X |
| 4,541,228 | 9/1985 | Petersen | 53/572 |
| 4,644,735 | 2/1987 | Savigny | 53/384.1 X |
| 4,689,937 | 9/1987 | Finan, Sr. et al. | 53/502 |
| 4,981,009 | 1/1991 | Gianelli | 53/384.1 X |
| 5,029,728 | 7/1991 | Su | 53/571 X |
| 5,109,651 | 5/1992 | Stuart | 53/502 |

FOREIGN PATENT DOCUMENTS

| | | |
|---|---|---|
| 0002075 | 5/1979 | European Pat. Off. . |
| 1-33455 | 10/1989 | Japan . |

OTHER PUBLICATIONS

International Application Published Under the Patent Cooperation Treaty (PCT) International Publication No. WO 92/06006; International Publication Date: 16 Apr. 1992; Inventor: Stuart; Title: Ice Bagger.

*Primary Examiner*—John Sipos
*Assistant Examiner*—Daniel Moon
*Attorney, Agent, or Firm*—Nikaido, Marmelstein, Murray & Oram

[57] ABSTRACT

A bagging apparatus includes a bag storage mechanism arranged to store a number of stacked bags, a bag feeding mechanism arranged under a delivery chute and opposed to the bag storage mechanism, the bag feeding mechanism being provided at its upper end portion with clamping mechanisms for grasping an upper front side portion of a first bag in the stored bags and being tiltably mounted at its lower end portion to be moved toward and away from the bag storage mechanism for feeding the first bag grasped by the clamping mechanisms below the delivery chute, a bag support mechanism having a support rod arranged to support an upper rear side portion of the first bag when it is fed by the bag feeding mechanism and to cooperate with the clamping mechanisms for deploying the upper opening of the first bag, a sealing mechanism arranged to seal the upper opening of the bag when a predetermined amount of articles has been supplied into the deployed bag from the delivery chute, and a tilting mechanism arranged below the bag support mechanism to support a bottom portion of the bag until the predetermined amount of articles is bagged and the upper opening of the bag is sealed and to slide down the sealed bag of articles therefrom when it has been tilted.

13 Claims, 39 Drawing Sheets

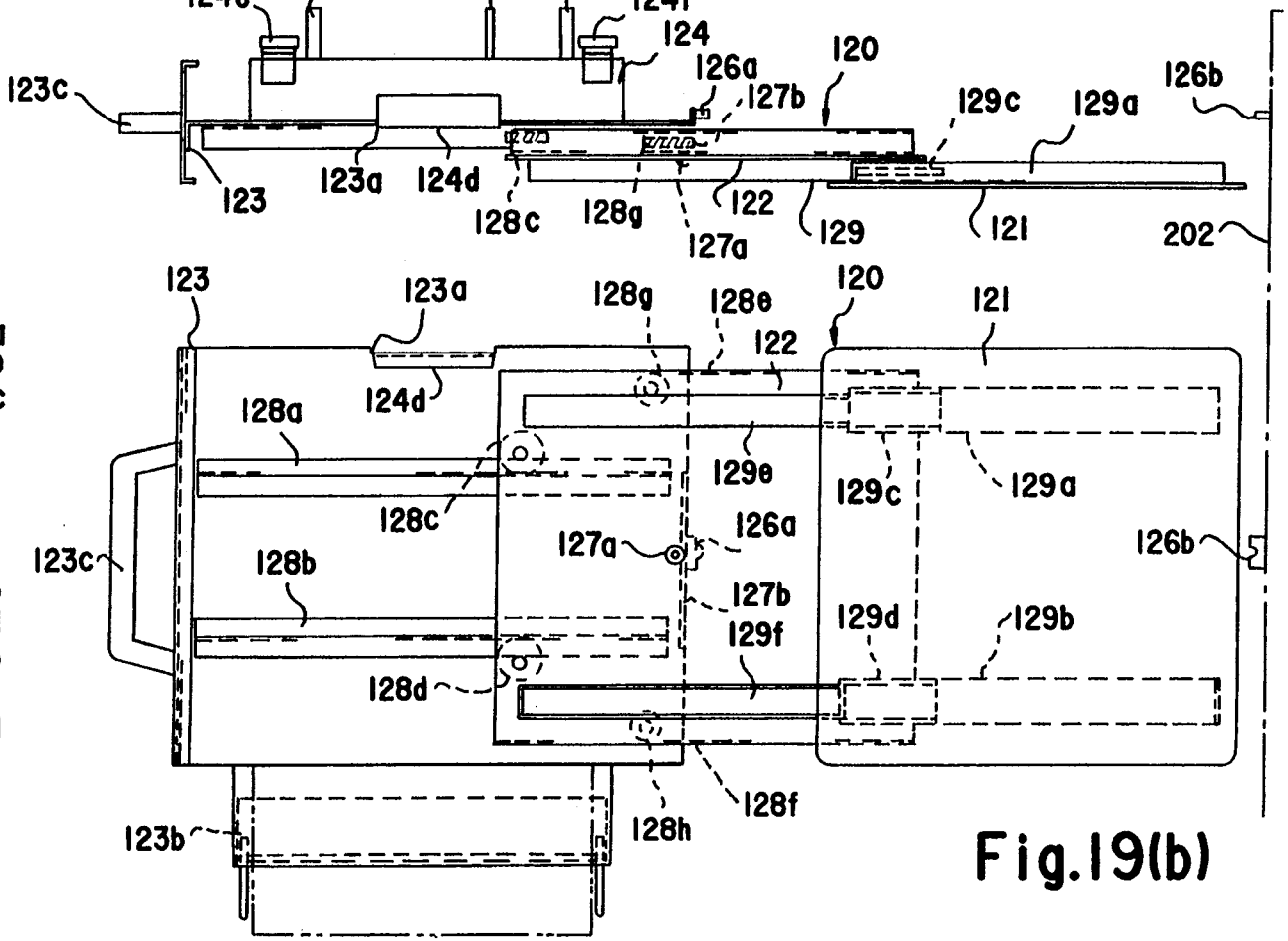
Fig.19(a)
Fig.19(b)
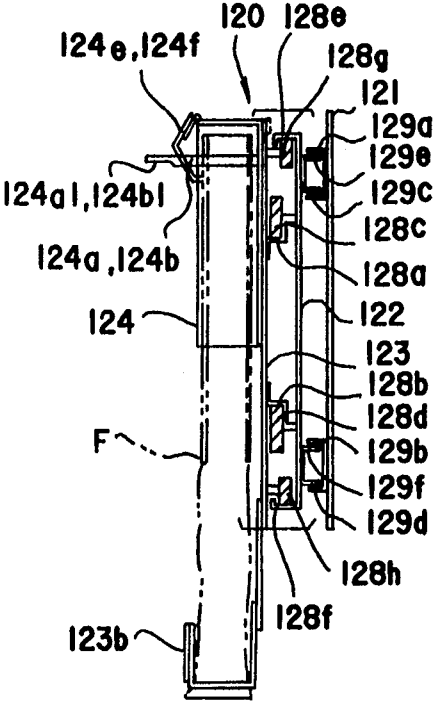
Fig.19(c)

Fig.24(a)
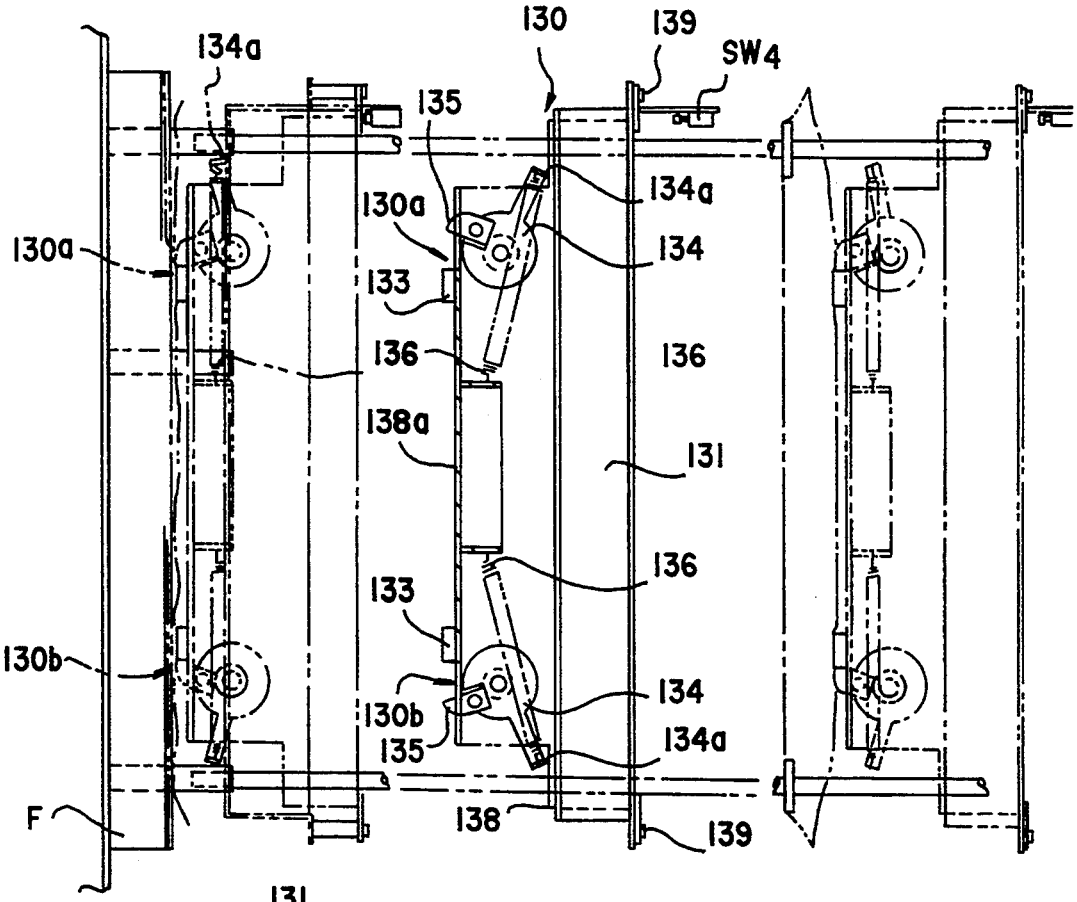
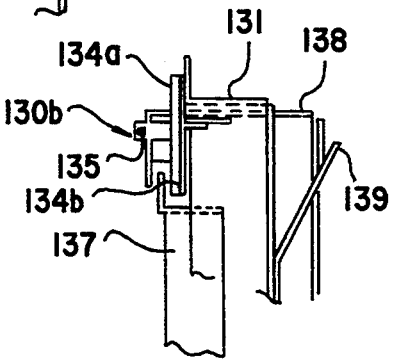
Fig.24(b)
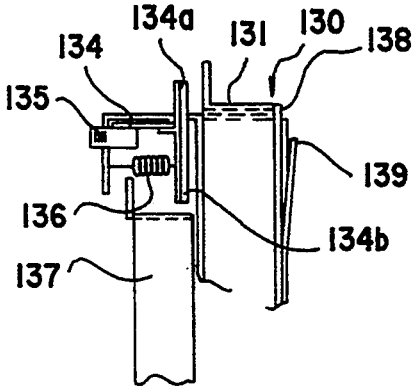
Fig.24(c)

Fig.25(a)
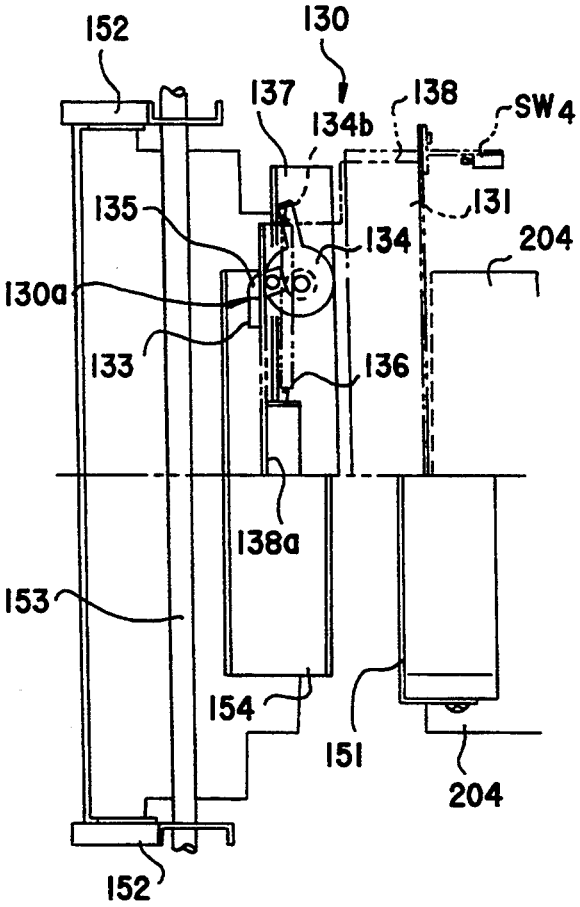
Fig.25(b)
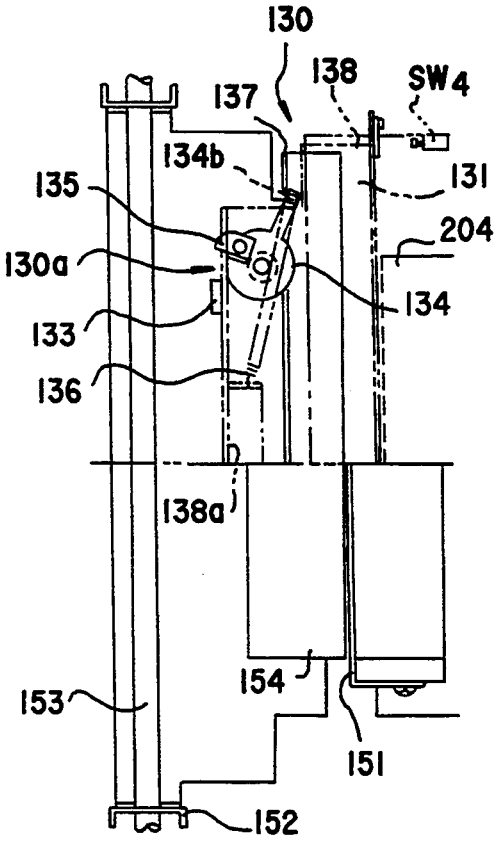
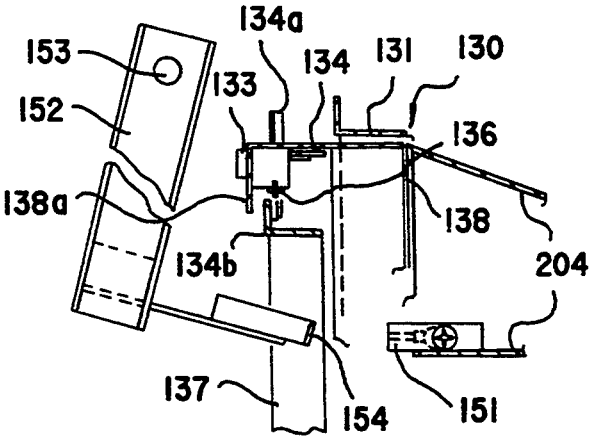
Fig.25(c)
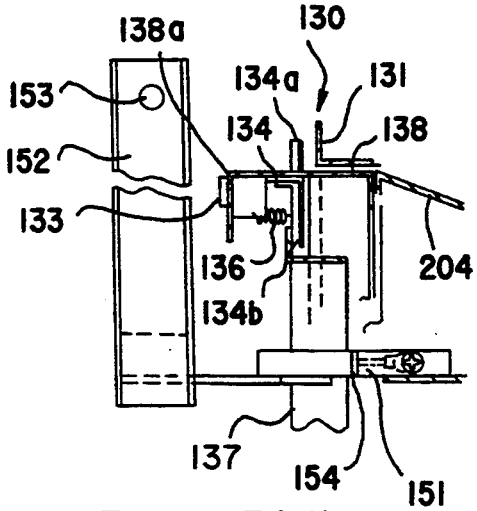
Fig.25(d)

226
229
221
225
224
229
223
F
229
221
229
226
224a
224c
224b
220
224
225
225b
225a
223b
223
223a
F
226
221
229a
229b
229c
229b
225
224a
224c
224b
224
229e
229f
223
223a
F

BAGGER

This application is a continuation of application Ser. No. 07/852,065 filed Mar. 16, 1992 abandoned.

BACKGROUND OF THE INVENTION

1. Field of the Invention

The present invention relates to an apparatus for bagging solid articles of a predetermined shape such as ice cubes and sealing the bag of articles to automatically store the sealed bag of articles in a stocker or the like.

2. Description of the Prior Art

A bagging apparatus of this kind is proposed, for example, in Japanese Utility Model Publication No. 1-33455, The bagging apparatus comprises a bag storage mechanism arranged below an ice delivery chute at one side thereof for storing a number of vertically stacked bags, a feeding mechanism arranged above the bag storage mechanism and having a suction pad movable for feeding a first bag in the stored bags under the ice delivery chute in such a manner that an opening of the bag is positioned upward, a support mechanism having a pair of clamping means arranged to hold both sides of the upper end of the bag fed by the feeding mechanism, a bag deploying mechanism for deploying the upper opening of the bag, which deploying mechanism includes means for moving the pair of clamping means closer to each other and means for moving a first suction pad for sucking one side of the upper end of the bag and a second suction pad for sucking the other side of the upper end of the bag away from each other, a sealing mechanism for sealing the upper opening of the bag when a predetermined amount of articles has been supplied into the bag, and a discharge chute arranged below the support mechanism for sliding down the sealed bag of articles when the action of the support mechanism has been released.

In the conventional bagging apparatus described above, the first bag in the stored bags is held by suction force of the suction pad when it is fed under the ice delivery chute. It is, however, difficult to increase the suction force of the pad. In addition, the process of feeding the bag under the ice delivery chute and deploying the upper opening of the bag is carried out by the feeding mechanism, the support mechanism and the deploying mechanism. With such an arrangement of these mechanisms, the bagging apparatus becomes complicated in construction.

SUMMARY OF THE INVENTION

It is, therefore, a primary object of the present invention to provide a bagging apparatus wherein the process of feeding the foremost bag from the stored bags under the ice delivery chute and deploying the upper opening of the foremost bag is reliably carried out in a simple construction. According to the present invention, the object is attained by providing a bagging apparatus which comprises a bag storage mechanism arranged to store a number of stacked bags the openings of which are positioned upward, a bag feeding mechanism arranged under a delivery chute and opposed to the bag storage mechanism, the bag feeding mechanism being provided at its upper end portion with clamping means for grasping an upper front side portion of a foremost bag in the stored bags and being tiltably mounted at its lower end portion to be moved toward and away from the bag storage mechanism for feeding the foremost bag grasped by the clamping means below the delivery chute, a bag support mechanism having a support rod arranged to support an upper rear side portion of the foremost bag when it is fed by the bag feeding mechanism and to cooperate with the clamping means for deploying the upper opening of the foremost bag, a sealing mechanism arranged to seal the upper opening of the bag when a predetermined amount of articles has been supplied into the deployed bag from the delivery chute, and a tilting mechanism arranged below the bag support mechanism to support a bottom portion of the bag until the predetermined amount of articles is bagged and the upper opening of the bag is sealed and to slide down the sealed bag of articles therefrom when it has been tilted.

BRIEF DESCRIPTION OF THE DRAWINGS

FIG. 11(*b*) illustrates a receiving plate of a measuring mechanism in the bagging apparatus;

FIG. 15(*b*) is a cross-sectional view taken along line B—B in FIG. 15(*a*);

FIG. 15(*c*) is a cross-sectional view taken along line C—C in FIG. 15(*a*);

FIG. 16(*b*) is a side view of the ice bagging apparatus shown in FIG. 16(*a*);

FIG. 19(*a*) is a plan view of a bag storage mechanism in the bagging apparatus shown in FIG. 17;

FIG. 19(*b*) is a front view of the bag storage mechanism shown in FIG. 19(*a*);

FIG. 19(*c*) is a sectional view of the bag storage mechanism shown in FIG. 19(*a*);

FIG. 24(*a*) illustrates a condition where the clamping mechanism in the bagging apparatus is in a gripping action;

FIGS. 24(*b*) and 24(*c*) each are a side view illustrating movement of a swingable lever shown in FIG. 24(*a*);

FIGS. 25(*a*) and 25(*b*) each are a plan view illustrating a condition where the clamping mechanism in the bagging apparatus is in a released action;

FIGS. 25(*c*) and 25(*d*) each are a side view illustrating the condition where the clamping mechanism in the bagging apparatus is in the released action;

FIG. 26(*b*) is a side view of the bag support mechanism shown in FIG. 26(*a*).

FIG. 31(*b*) is a side view illustrating the condition where the bag has not been accurately held by the clamping mechanism;

FIG. 32(*c*) is a side view of the modification shown in FIG. 32(*a*);

DESCRIPTION OF THE PREFERRED EMBODIMENTS

Figure 1:
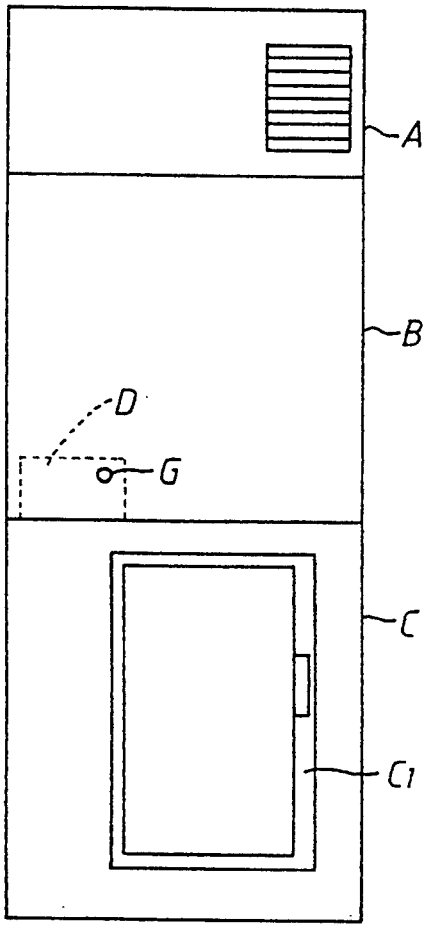
FIG. 1 is a front view of a first embodiment of an ice bagging apparatus according to the present invention.

Certain preferred embodiments of the present invention will now be described with reference to the accompanying drawings. FIG. 1 illustrates a first embodiment of the present invention which comprises an ice making machine A, an ice bagging apparatus B, a stocker (freezing storage cabinet) C provided with a door C1 at its front, and a control device D for controlling the operation of those components. The ice making machine A is constructed to automatically produce ice cubes E of a predetermined shape at its ice making cycle and release the ice cubes therefrom at its defrost cycle to supply them to the bagging apparatus B. (see FIG. 3) The ice making machine A itself is well known, for example, in U.S. Pat. No. 4,791,792.

Figure 2:
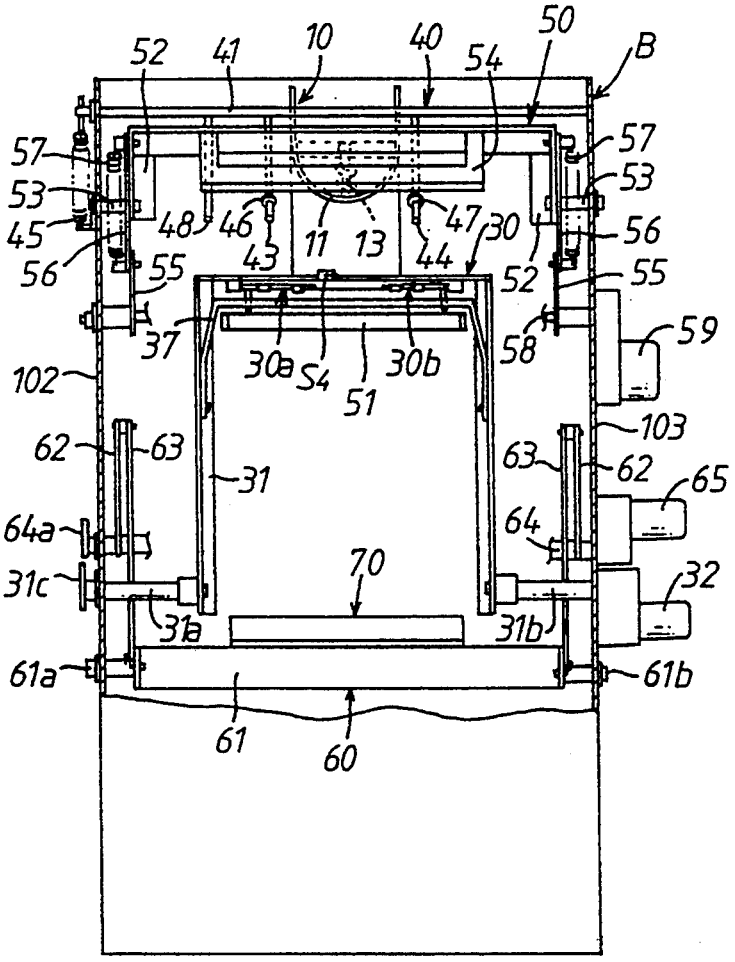
FIG. 2 is a partly broken front view of the bagging apparatus shown in FIG. 1.
Figure 3:
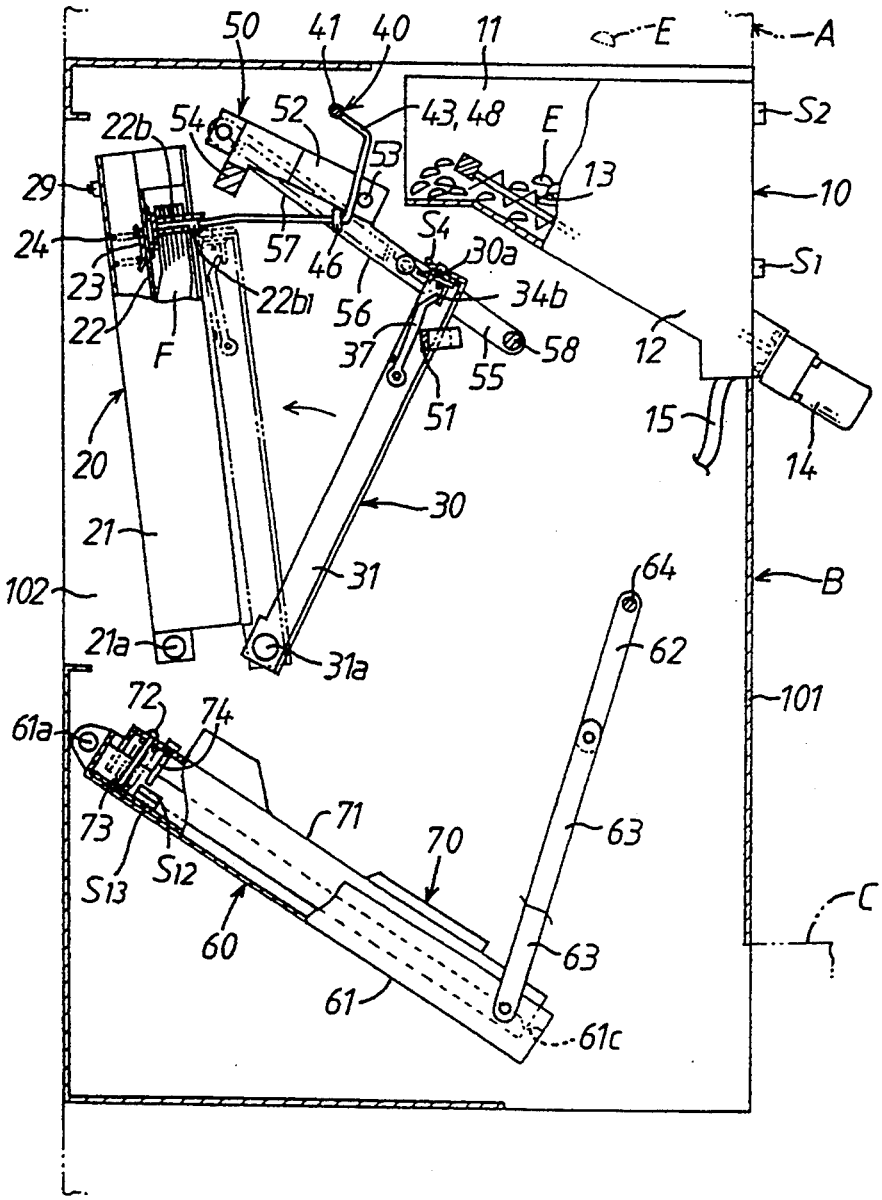
FIG. 3 is a sectional side view of the bagging apparatus.

As shown in FIGS. 2 and 3, the ice bagging apparatus B comprises an ice storing/feeding mechanism 10 arranged to correspond with an ice discharge duct (not shown) of the ice making machine A, a bag storage mechanism 20 arranged in front (on the left-hand side in FIG. 3) of an ice delivery chute 11 of the ice storing-/feeding mechanism 10 to store a number of stacked bags F therein, a bag feeding mechanism 30 arranged below the delivery chute 11 to feed a foremost bag F of the stacked bags to a predetermined position shown by imaginary lines in FIG. 12, a bag support mechanism 40 arranged between the bag storage mechanism 20 and the bag feeding mechanism 30 located at its resting position as shown by solid lines in FIG. 3 to cooperate with the bag feeding mechanism 30 for deploying the foremost bag F and supporting it thereon, a sealing mechanism 50 arranged to seal the upper opening of the foremost bag F supplied with a predetermined amount of ice cubes, a tilting mechanism 60 arranged under the bag support mechanism 40 to slide the sealed bag of ice cubes into the stocker C, and a measuring mechanism 70 integrally assembled with the tilting mechanism 60 to measure the amount of ice cubes packaged in the bag F.

As shown in FIG. 3, the ice storing/feeding mechanism 10 comprises an ice storage tank 12 formed with the ice delivery chute 11 and mounted on a frame 101 to receive the ice cubes E falling from the ice making machine A, an auger 13 rotatably mounted within the tank 12 to transport the ice cubes E along the bottom of the delivery chute 11, an electric motor 14 mounted on the frame 101 through a reduction gear to rotate the auger 13, and a drain pipe 15 connected to the bottom of tank 12 to discharge the water of melted ice cubes outwardly. The electric motor 14 is arranged to be activated under control of the control device D, and the tank 12 is provided at its lower and upper portions with optical switches S1 and S2 which are arranged to detect presence of the ice cubes in tank 12 and connected to the control device D.

Figure 4:
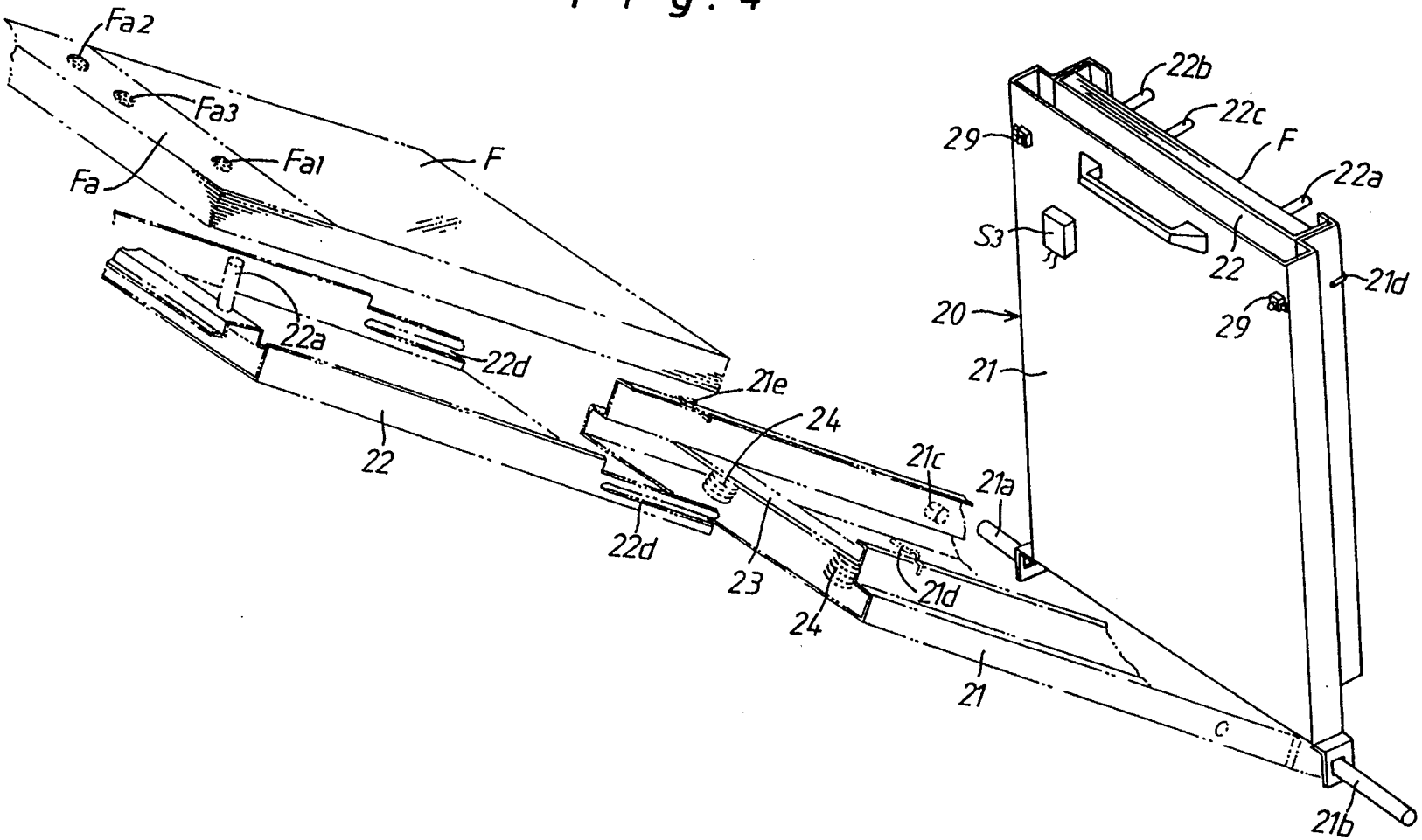
FIG. 4 is a perspective view of a bag storage mechanism in the bagging apparatus.
Figure 6:
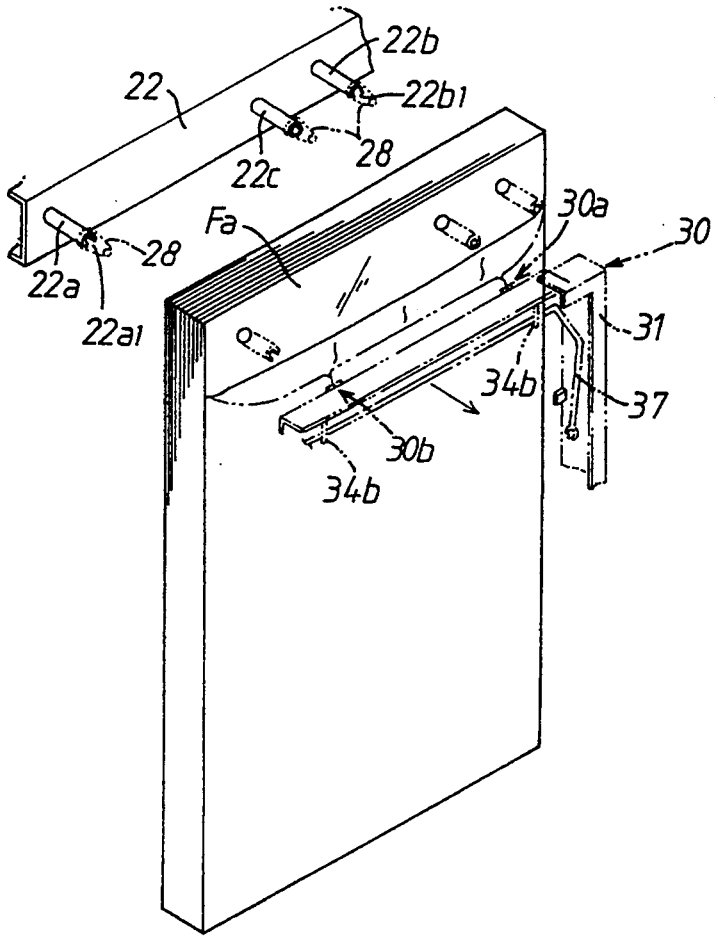
FIG. 6 is a perspective view showing a relationship among indiviual pins of a cassette, bags and clamping members of a bag feeding mechanism in the bagging apparatus.

As shown in FIGS. 3 and 4, the bag storage mechanism 20 includes a cassette 21 tiltably mounted on a pair of spaced side plates 102 and 103 of the frame 101 by means of a pair of axially spaced support shafts 21*a* and 21*b* secured to its lower end portion. As shown in FIGS. 2 and 3, the side plates 102 and 103 are integrally assembled with the frame 101 of bagging apparatus B, and the cassette 21 is retained in a slightly inclined condition by means of a pair of fasteners 29 mounted to its rear side. The bag storage mechanism 20 further includes a cartridge 22 provided at its upper portion with a pair of spaced hollow support pins 22*a*, 22*b* and a positioning pin 22*c* and formed at its lower side portions with a pair of slots 22*d* which are telescopically engageable with a pair of corresponding pins 21*e* secured to the side portions of cassette 21. As shown in FIGS. 3 and 6, the hollow support pins 22*a*, 22*b* are formed at their bottom sides with axial slits $22a_1$, $22b_1$. A lateral retainer plate 23 is assembled within the cassette 21 and loaded by a pair of spaced coil springs 24 for engagement with an upper rear surface of the cartridge 22. An optical switch $S_3$ is secured to an upper rear surface of the cassette 21 to detect presence of bags F through holes (not shown) formed in the cassette 21 and cartridge 22 and is connected to the control device D. In the bag storage mechanism 20, a number of stacked bags F are hung on the support pins 22*a*, 22*b*, 22*c* to be successively removed back ward. In addition, a pair of fastening pins 21*d* and 21*e* are fixed to the upper portion of cassette 21 to prevent the upper corners of the stacked bags F from warping.

Figure 5:
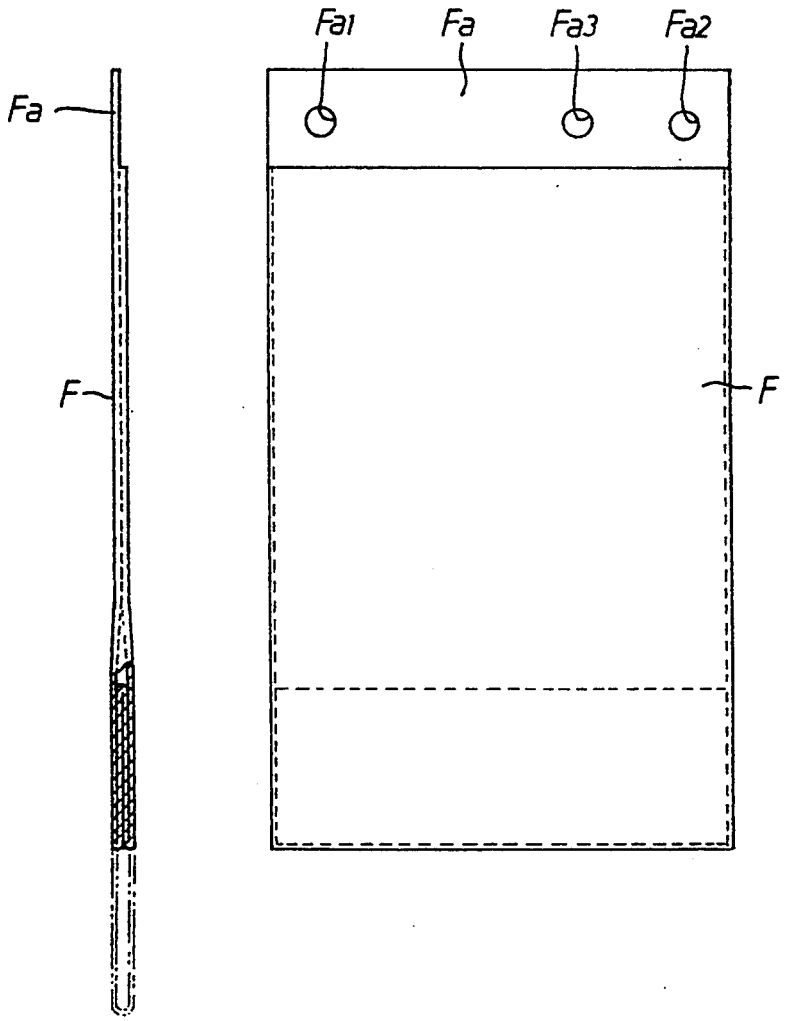
FIG. 5 illustrates a bag for use in the bagging apparatus.

As shown in FIG. 5, the bag F has a bottom portion inwardly folded up to be expanded downward when received ice cubes and has an attachment portion Fa formed with mounting holes Fa1, Fa2 and Fa3 for engagement with the support pins 22*a*, 22*b* and 22*c* of cartridge 22. In the bag storage mechanism 20, the fasteners 29 are released so that the cassette 21 can be tilted forward for replacement of the cartridge 22 as shown by imaginary lines in FIG. 4. Thus, the bags F can be supplemented in a simple manner. When a number of stacked bags F are hung on the support pins 22*a*, 22*b*, 22*c* of cartridge 22, hollow conical caps 28 are fitted on the free ends of support pins 22*a*, 22*b*, 22*c* as shown in FIG. 6 to facilitate setting of the stacked bags F. In a condition where the stacked bags F have been hung on the support pins 22*a*, 22*b*, 22*c*, the bags F are fully stretched at their attachment portions Fa and loosened at their front side portions to be easily grasped by clamping mechanisms 30*a*, 30*b* of the bag feeding mechanism 30.

Figure 7:
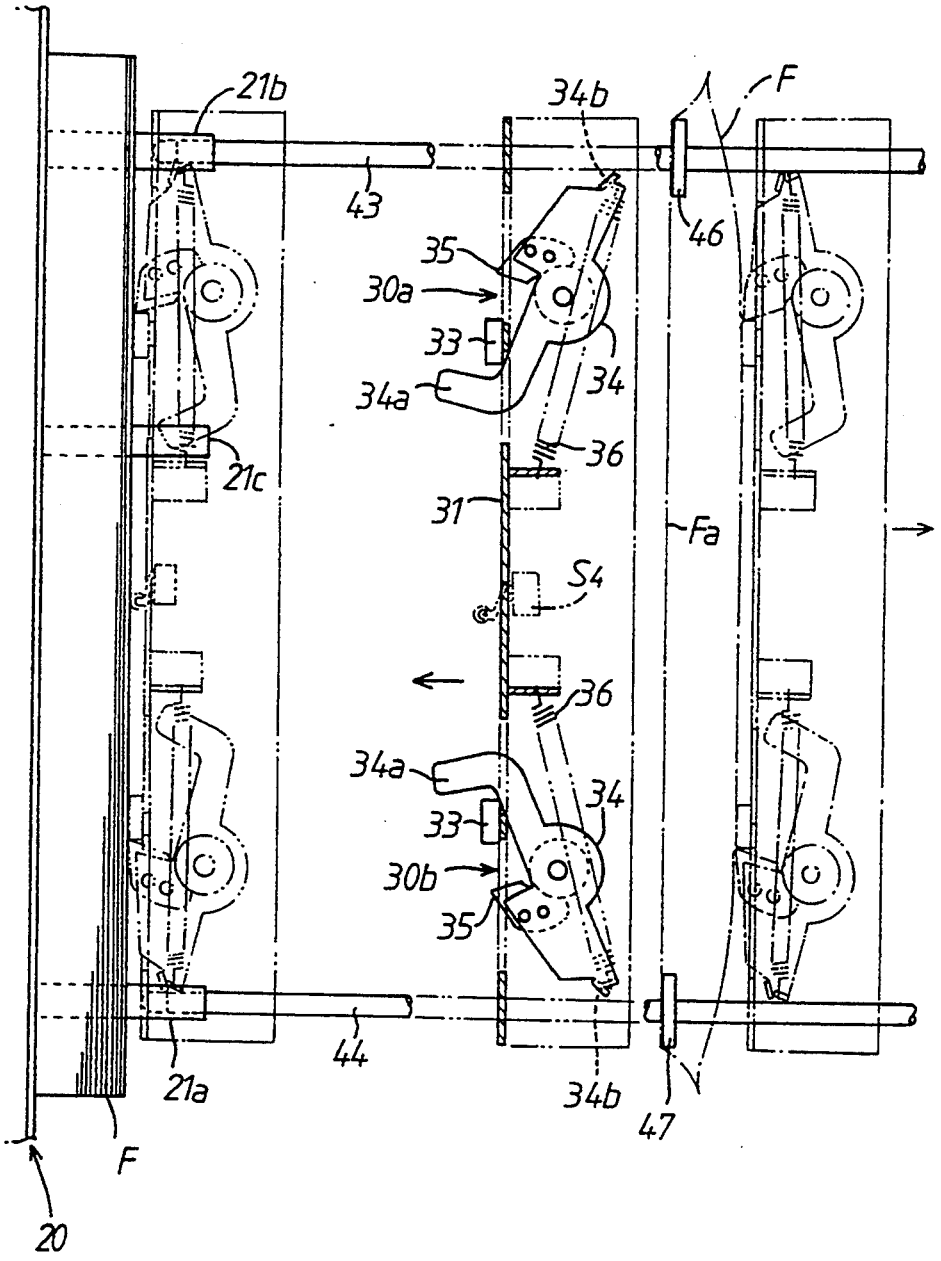
FIG. 7 is a plan view showing a relationship among the bag storage mechanism, both the clamping members and both bag support rods in the bagging apparatus.
Figure 8:
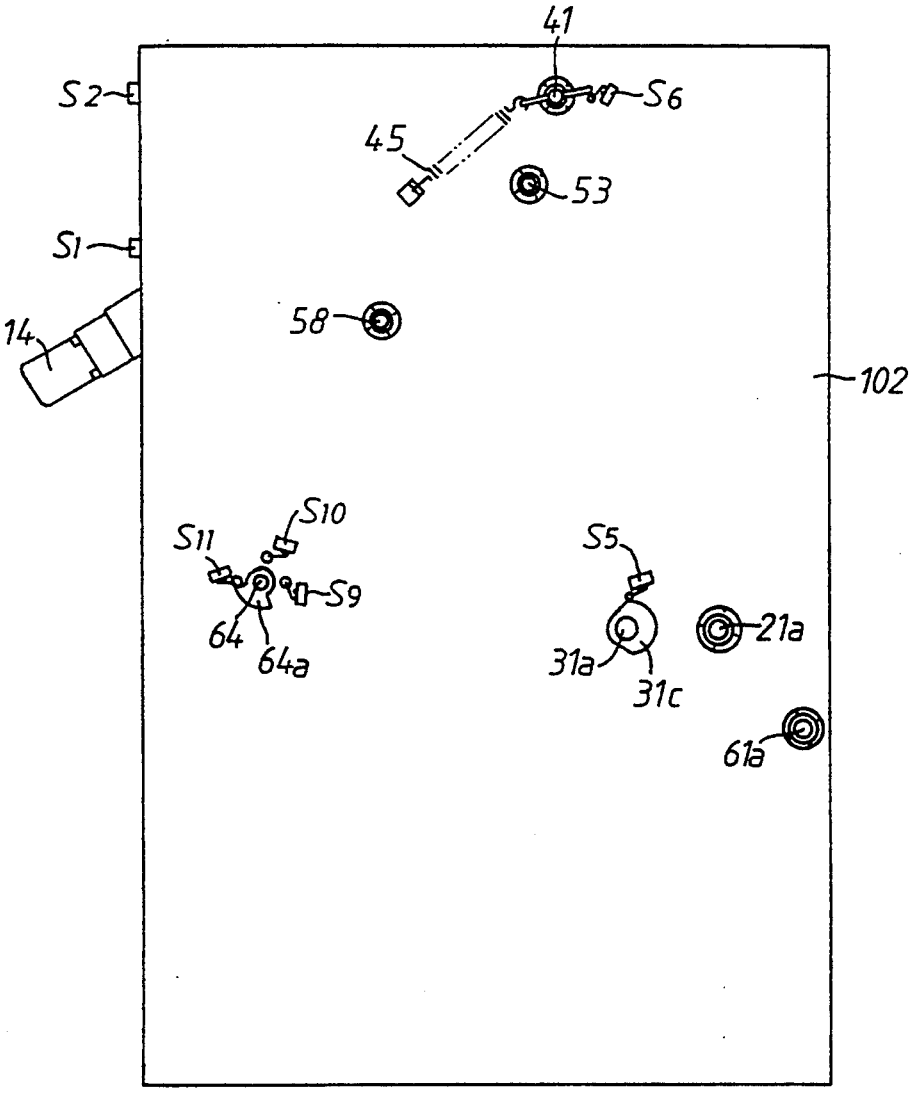
FIG. 8 is a left side view of the bagging apparatus.

As shown in FIGS. 2, 3, 7 and 8, the bag feeding mechanism 30 comprises an arch-shaped tiltable frame 31 tiltably mounted on the side plates 102 and 103 of the frame 101 by means of a pair of axially spaced support shafts 31*a*, 31*b* fixed to its lower end portions (see FIG. 2), a reversible electric motor 32 mounted to the side plate 103 to be activated under control of the control device D for tilting the tiltable frame 31, a pair of spaced clamping mechanisms 30*a*, 30*b* mounted on the upper portion of tiltable frame 31, a touch switch S4 mounted on the center of the upper portion of tiltable frame 31 to detect the first bag in the stored bags F in the bag storage mechanism 20 when brought into contact therewith, and a switch S5 mounted to the side plate 102 as shown in FIG. 8 and maintained in engagement with a cam plate 31*c* fixed to the support shaft 31*a* to detect the fact that the arm 31 has been returned to its resting position shown in FIG. 3.

As shown in FIG. 7, each of the clamping mechanisms 30*a*, 30*b* comprises a stationary pawl 33 of rubber secured to the front side of the upper portion of tiltable frame 31, a swingable lever 34 pivoted to the upper portion of arm 31, a movable pawl 35 of rubber secured to the swingable lever 34 to be engaged with or disengaged from the stationary pawl 33, and a turnover coil spring 36 connected at its opposite ends with the tiltable frame 31 and the swingable lever 34 to bias the swingable lever 34 in a forward direction for pressing the movable pawl 35 against the stationary pawl 33 when engaged therewith as shown by imaginary lines in FIG. 7 and to bias the swingable lever 34 in a reverse direction when the movable pawl 35 is disengaged from the stationary pawl 33 as shown by solid lines in FIG. 7. The swingable lever 34 has an operation arm 34*a* arranged to rotate the swingable lever 34 in the forward direction when brought into contact with the first bag in the stored bags F and a return arm 34*b* arranged to rotate the swingable lever 34 in the reverse direction when pushed by abutment against a release lever 37 tiltably mounted to the tiltable frame 31 as shown in FIGS. 2, 3 and 6.

As shown in FIGS. 2, 3, 7 and 8, the bag support mechanism 40 comprises a shaft 41 rotatably mounted on the side plates 102 and 103 of the frame 101, a pair of parallel bag support rods 43 and 44 fixed at their one ends to the shaft 41, a tension coil spring 45 for biasing the shaft 41 and bag support rods 43 and 44 clockwisely in FIG. 3 (see FIG. 2), and rubber rings 46 and 47 respectively fixed to the bag support rods 43 and 44 to retain the attachment portion Fa of bag F by engagement therewith at a predetermined position. The bag support rods 43 and 44 each are formed in a U-letter shape and detachably engaged with the support pins 22*a* and 22*b* of the bag storage mechanism 20 to be pressed by a lateral heat seal bar 54 of the sealing mechanism 50. The bag support rods 43 and 44 are maintained in engagement with the support pins 22*a* and 22*b* when the heat seal bar 54 of the sealing mechanism 50 is placed in its resting position as shown in FIG. 3. When the heat seal bar 54 of the sealing mechanism 50 is rotated downward, the bag support rods 43 and 44 are pushed by engagement with the seal bar 54 to rotate downward against the biasing force of spring 45 and disengaged from the support pins 22*a* and 22*b*. When a sealed bag of ice cubes fails into the stocker C, the bag support rods 43 and 44 are further rotated downward by weight of the bagged ice cubes against the biasing force of spring 45.

Figure 12:
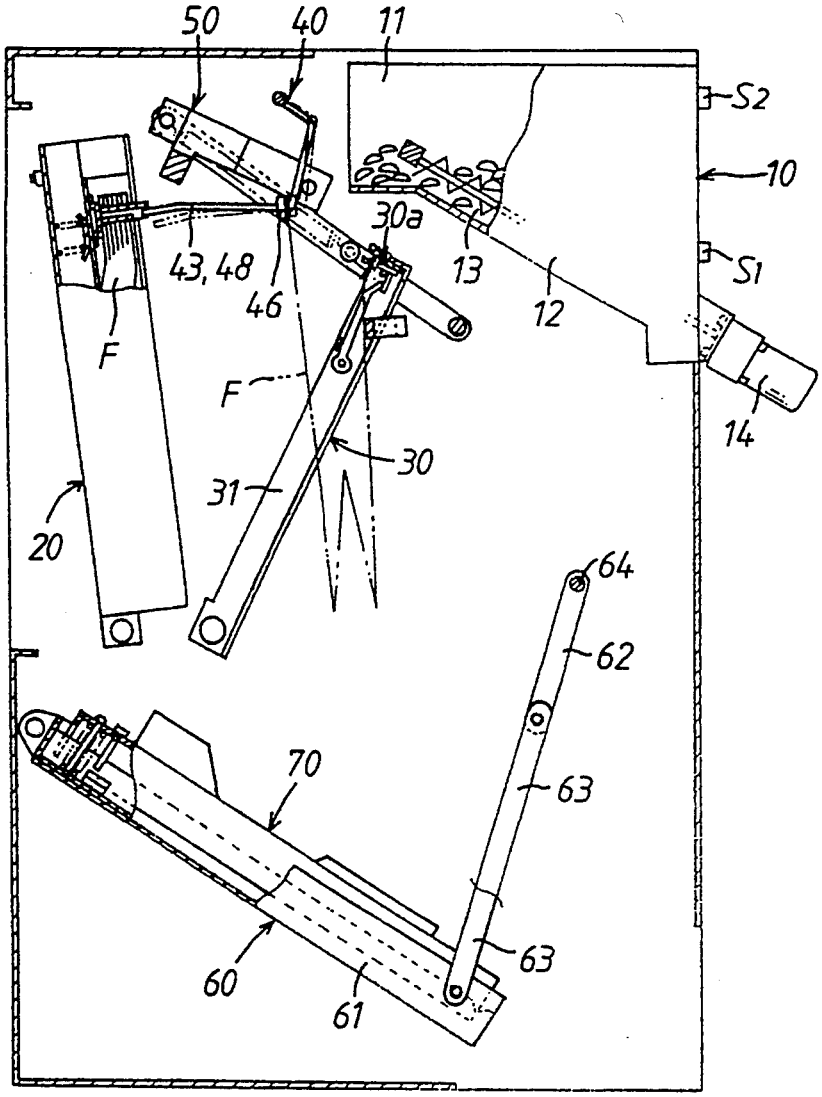
FIG. 12 illustrates a condition where the feeding mechanism has been operated to feed a bag under an ice delivery chute as shown by imaginary lines.

As shown in FIG. 8, the bag support mechanism 40 is provided with a switch S6 which is operated by slight rotation of the support shaft 41 when the bag F is hung on the bag support rods 43 and 44 at the predetermined position and is slightly stretched by the clamping mechanisms 30*a*, 30*b* to be expanded at its upper opening as shown in FIG. 12. As shown in FIG. 2, a support rod 48 of the same shape as that of the bag support rods 43, 44 is fixed to the support shaft 41 at its one end. When the lateral seal bar 54 is moved toward a heater block 51, the support rod 48 is engaged with a portion of the seal bar 54 to retain the bag support rods 43, 44 at their displaced positions shown by imaginary lines in FIG. 14, thereby to restrict return movement of the bag support rods 43, 44 caused by the biasing force of spring 45.

Figure 9:
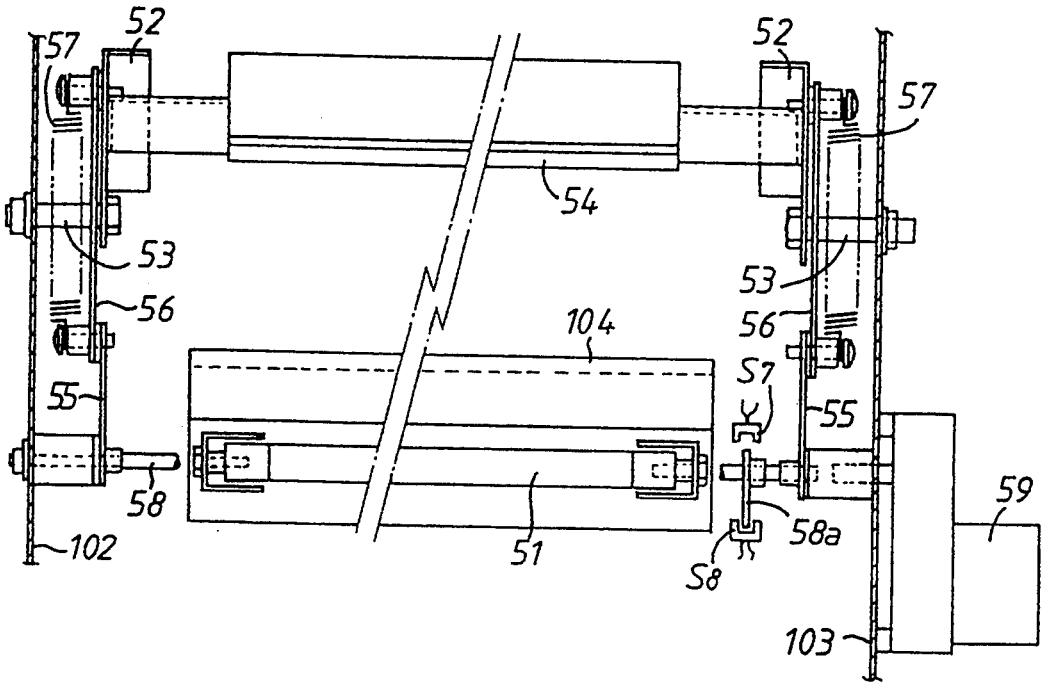
FIG. 9 is a front view of a sealing mechanism in the bagging apparatus.
Figure 9:
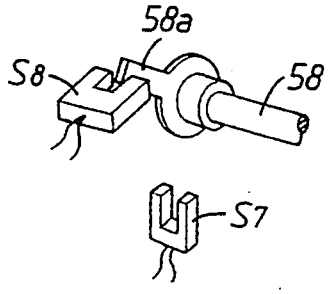
Figure 10:
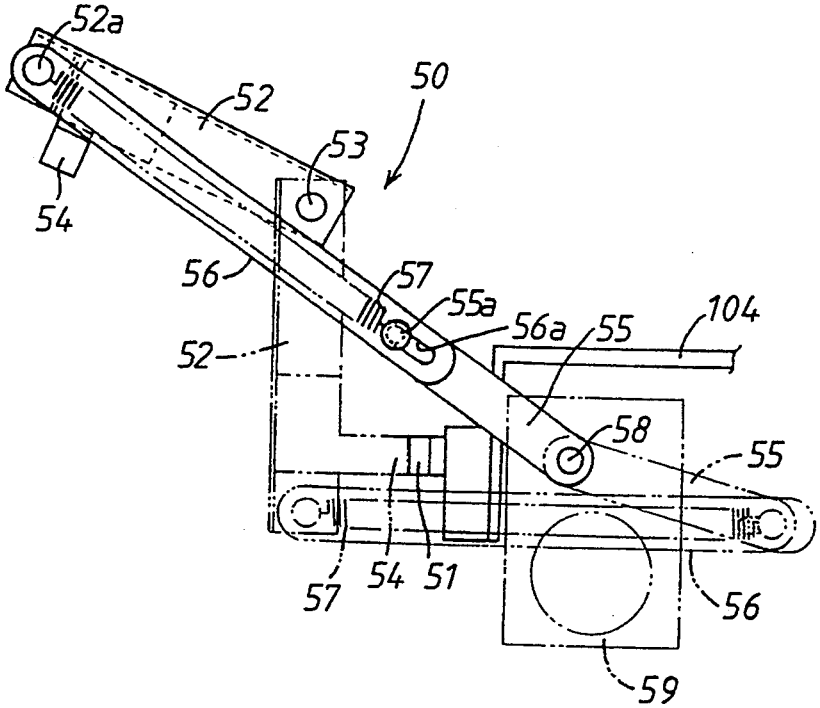
FIG. 10 is a side view of the sealing mechanism.

The sealing mechanism 50 is constructed to thermally seal the upper opening portion of the bag F supplied with a predetermined amount of ice cubes. As shown in FIGS. 9 and 10, the sealing mechanism 50 comprises the heater block 51 mounted on the frame 101 by means of a lateral bracket 104, the arch-shaped heat seal bar 54 rotatably mounted on the side plates 102 and 103 by means of a pair of axially spaced support arms 52 and a pair of axially spaced support shafts 53, a pair of axially spaced drive arms 55 rotatably mounted on the side plates 102 and 103, a drive shaft 58 rotatably mounted on the side plates 102 and 103 at its opposite ends and operatively connected to the support arms 52 by means of the drive arms 55, linkages 56 and coil springs 57, a reversible electric motor 59 mounted on the side plate 103 through a reduction gear to be activated under control of the control device D for rotating the drive shaft 58, a rotary detection plate 58*a* mounted on the drive shaft 58 for rotation therewith, an optical switch S7 arranged to cooperate with the rotary detection plate 58*a* for detecting the drive arm 55 when it has been moved to a predetermined position, and an optical switch S8 arranged to cooperate with the rotary detection plate 58*a* for detecting the drive arm 55 when it has been returned to its resting position as shown in FIG. 3.

As shown in FIG. 10, each of the linkages 56 has an elongated hole 56*a* through which it is engaged with a pin 55*a* fixed to the free end of the associated drive arm 55 to permit slight rotation of the drive arm 55 when the seal bar 54 has been brought into engagement with the heater block 51 as shown by an imaginary line. Each of the coil springs 57 has one end engaged with the pin 55*a* and the other end engaged with a pin 52*a* which interconnects the support arm 52 and linkage 56. When the drive arm 55 is further rotated in a condition where the seal bar 54 has been brought into engagement with the heater block 51, the coil spring 57 acts to bias the seal bar 54 toward the heater block 51.

As shown in FIGS. 2 and 3, the tilting mechanism 60 comprises a base member 61 rotatably mounted on the side plates 102 and 103 by means of a pair of axially spaced shafts 61*a* and 61*b* secured to its front end, two pairs of axially spaced linkages 62, 63 arranged to support the rear end of base member 61 movably in a vertical direction, a drive shaft 64 rotatably mounted on the side plates 102 and 103 and connected to one end of the respective linkages 62, and a reversible electric motor 65 mounted on the side plate 103 through a reduction gear to be activated under control of the control device D for rotating the drive shaft 64. As shown in FIGS. 2 and 8, the tilting mechanism 60 further comprises a switch S9 mounted on the side plate 102 to cooperate with a cam member 64*a* fixed to the drive shaft 64 for detecting a first predetermined rotation amount of the drive shaft 64, a switch S10 mounted on the side plate 102 to cooperate with the cam member 64*a* for detecting a second predetermined rotation amount of the drive shaft 64 (where the base member 61 is horizontally supported), and a switch S11 mounted on the side plate 102 to cooperate with the cam member 64*a* for detecting the fact that the base member 61 has been returned to its resting position as shown in FIG. 3).

Figure 11A:
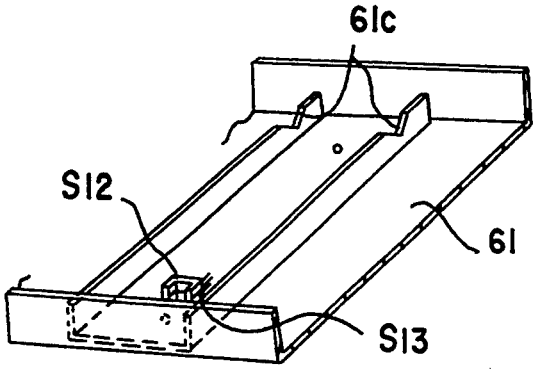
FIG. 11(*a*) illustrates a base member of a tilting mechanism.
Figure 11B:
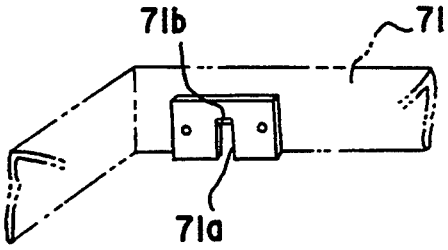

The measuring mechanism 70 is provided to measure a predetermined amount of ice cubes to be bagged. As shown in FIGS. 3 and 11, the measuring mechanism 70 comprises a receiving plate 71 assembled with the base member 61, a mounting screw 72 adjustably threaded into the base member 61 through a front end portion of receiving plate 71 to restrict upward movement of the receiving plate 71 relative to the base member 61, a compression coil spring 73 disposed between the base member 61 and the receiving plate 71 to bias the receiving plate 71 upward, a detection rod 74 adjustably mounted to the front end portion of receiving plate 71, an optical switch S12 mounted on the base member 61 to cooperate with the detection rod 74 for detecting the fact that the coil spring 73 has been compressed by the load acting on the receiving plate 71 in a first predetermined amount, an optical switch S13 mounted on the base member 61 to cooperate with the detection rod 74 for detecting the fact that the coil spring 73 has been compressed by the load acting on the receiving plate 71 in a second predetermined amount. As shown in FIG. 11, the receiving plate 71 is provided at its rear end with a pair of spaced notches 71*a* each formed with a sharp edge 71*b* and is engaged with a pair of spaced V-grooves 61*c* of base member 61 at its sharp edges 71*b*. In addition, the receiving plate 71 is protruded upward at its front and rear portions to position the bag supplied with ice cubes thereon and support it upright.

Assuming that in operation a main switch G shown in FIG. 1 has been operated, the ice making machine A and stocker C are activated in response to a control signal from the control device D so that a predetermined amount of ice cubes is produced at each ice making cycle and falls into the tank 12 of the bagging apparatus B and that the interior of the stocker C is refrigerated to a temperature suitable for storing the bagged ice cubes. If an excessive amount of ice cubes is stored in the tank 12 due to abnormal operation of the bagging apparatus B (for instance, malfunction of some electric motor or mechanism), the switch S2 is operated so that the ice making machine A is deactivated in response to a control signal from the control device D. When the bagging apparatus B is activated, the component parts of the bagging apparatus B are returned to their resting positions under control of the control device D.

When the switch S1 is operated by detection of the ice cubes supplied into the tank 12, the electric motor 32 of the bag feeding mechanism 30 is activated in response to a control signal from the control device D to tilt the arm 31 of the bag feeding mechanism 30 forward from its resting position. When the upper portion of tiltable frame 31 approaches the bags F stored in the bag storage mechanism 20, the operation arms 34*a* of swingable levers 34 in the clamping mechanisms 30*a*, 30*b* are brought into contact with a foremost bag in the stored bags F to rotate the swingable levers 34 against the biasing force of springs 36. Thus, the movable pawls 35 are engaged with the stationary pawls 33 to grasp the front side portion of the foremost bag F, and the switch S4 is operated to deactivate the electric motor 32 under control of the control device D. Upon lapse of a predetermined time (for instance, one second), the electric motor 32 is activated under control of the control device D to rotate in a reverse direction for tilting the tiltable frame 31 toward its resting position. In this instance, the biasing force of springs 36 is turned over to maintain the engagement of pawls 35 and 33 as shown by the imaginary lines in FIG. 7.

When the tiltable frame 31 is tilted backward, the bag support rods 43, 44 are maintained in engagement with the support pins 22*a*, 22*b* of bag storage mechanism 20. Thus, the attachment portion Fa of the first bag grasped by the pawls 33, 35 is smoothly hung on the support rods 43, 44 at its mounting holes Fa1, Fa2 so that the upper opening of the bag is widely deployed under the ice delivery chute 11 as shown in FIG. 12. In this instance, the bag F is suspended from the support rods 43, 44 at its attachment portion and positioned by abutment with the rings 46, 47 on the support pins 43, 44, while the front side portion of the bag is stretched by the clamping mechanisms 30*a*, 30*b* of the bag feeding mechanism 30 to deploy the upper opening of the bag. When the support rods 43, 44 are slightly moved downward against the biasing force of spring 45, the switch S6 is operated to effect the following action. If in such operation the bag F may not be properly suspended from the support rods 43,44 due to defect in operation of the clamping mechanisms 30*a*, 30*b*, the switch S6 will not be operated to interrupt the following action, and an alarm will be issued.

Figure 13:
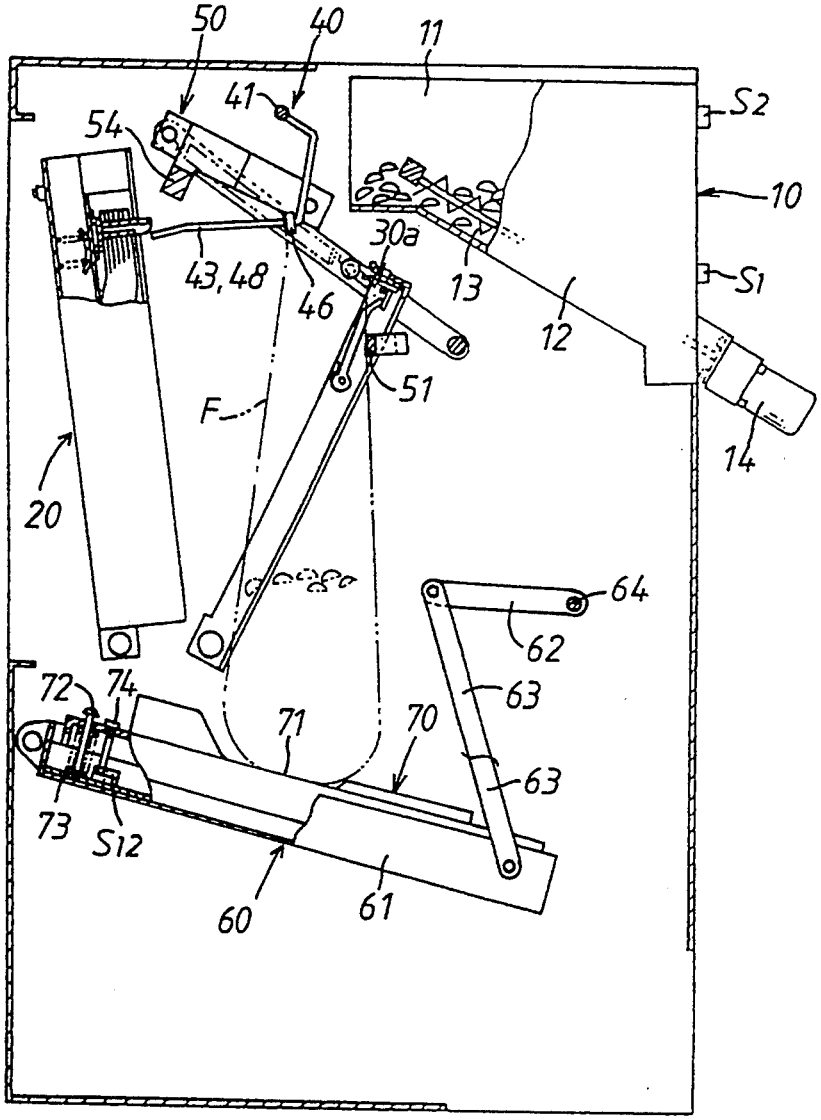
FIG. 13 illustrates a condition where about a half of a predetermined amount of ice cubes has been supplied into the bag.

When the arch-shaped tiltable frame 31 of the bag feeding mechanism 30 is returned to its resting position, the switch S5 is operated to deactivate the electric motor 32 in response to a control signal from the control device D and to activate the electric motor 14 of the ice delivery mechanism 10. Thus, the auger 13 is driven by the electric motor 14 to cause the ice cubes in tank 12 to fall into the deployed bag F through the delivery chute 11. When the switch S5 has been operated, the electric motor 65 is activated in response to a control signal from the control device D to lift the base member 61 from its resting position. When the switch S9 is operated by upward movement of the base member 61, the electric motor 65 is deactivated in response to a control signal from the control device D to stop the upward movement of base member 61. In such a condition, the base member 61 is retained at a slightly inclined angle as shown in FIG. 13, and the bag support rods 43, 44 are slightly rotated downward against the biasing force of spring 45 in accordance with a supply amount of ice cubes into the deployed bag F to avoid an excessive tension acting on the bag and to ensure accurate measurement of the bagged ice cubes.

Figure 14:
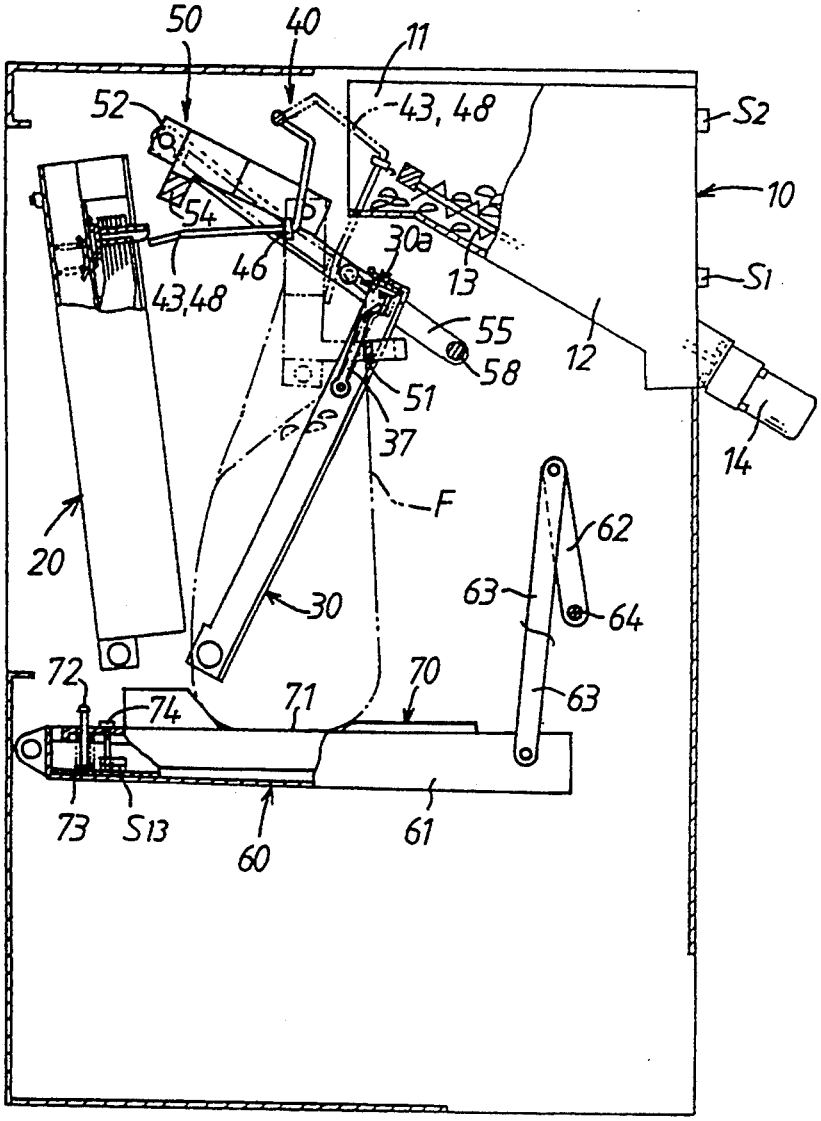
FIG. 14 illustrates a condition where the predetermined amount of ice cubes has been supplied into the bag.

When the bag F is supplied with about half of the predetermined amount of ice cubes, the switch S12 of the measuring mechanism 70 is operated to activate the electric motor 65 in the forward direction under control of the control device D thereby to further lift the base member 61. When the switch S10 is operated by upward movement of the base member 61, the electric motor 65 is deactivated in response to a control signal from the control device D to stop the upward movement of base member 61. In this instance, the base member 61 is horizontally retained as shown in FIG. 14. When the bag F is supplied with the predetermined amount of ice cubes, the switch S13 of the measuring mechanism 70 is operated to deactivate the electric motor 14 of the ice delivery mechansim 10 under control of the control device D thereby to stop the ice delivery action of auger 13. Subsequently, the electric motor 59 of the sealing mechanism 50 is activated under control of the control device D to rotate the drive shaft 59 in a forward direction thereby to move the drive arms 55 toward a predetermined position shown by an imaginary line in FIG. 10.

The movements of drive arms 55 are transmitted to the support arms 52 through the linkages 56. Thus, the support arms 52 are rotated to move the heat seal bar 54 toward the heater block 51, and the upper opening portion of the deployed bag F is clamped by the seal bar 54 and heater block 51. After the seal bar 54 has been engaged with the heater block 51, the rotation of support arms 52 is permitted at the enlongated holes **56*a* of linkages 56 so that the seal bar 54 is biased toward the heater block 51 by means of the resilient force of springs 57. In this instance, the bag support rods 43, 44, 48 are rotated counterclockwisely by engagement with the seal bar 54 and retained at a position indicated by an imaginary line in FIG. 14 so that the attachment portion Fa of bag F slides on the support rods 43, 44 toward a position where the front side portion of bag F is grasped by the clamping mechanisms 30*a*, 30*b*. Simultaneously, the release lever 37 of the bag feeding mechanism 30 is rotated by engagement with the seal bar 54 to move the return arms 34*b* of swingable levers 34 against the springs 36 thereby to disengage the movable pawls 35 from the stationary pawls 33**.

When the drive arms 55 are moved to the predetermined position, the optical switch S7 of the sealing mechanism 50 is operated to deactivate the electric motor 59 under control of the control device D, and the heater block 51 is energized for a predetermined time (for instance, 0.3 to 0.5 seconds) to thermally seal the upper opening of the bag F. Upon lapse of two seconds after energization of the heater block 51, the electric motor 59 of the sealing mechanism 50 is activated under control of the control device D to rotate in the reverse direction for returning the component parts of the sealing mechanism 50 to their resting positions. Upon lapse of seven seconds after energization of the heater block 51, the electric motor 65 of the tiliting mechanism 60 is activated under control of the control device D to rotate in the reverse direction for driving the drive shaft 64 in the reverse direction. Thus, the linkages 62 are moved downward to tilt the base member 61 downward for dropping the bagged ice cubes into the stocker C. When the bagged ice cubes fall into the stocker C, the bag support rods 43, 44 are rotated against the spring 45 to release the attachment portion Fa of the bag F therefrom. When the drive shaft 64 of the tilting mechanism 60 is driven in the reverse direction to return the base member 61 to its resting position, the switch S11 is operated to deactivate the electric motor 65 under control of the control device D. When the component parts of the sealing mechanism 50 are returned to their resting positions, the switch S8 is operated to deactivate the electric motor 59 under control of the control device D.

If the stored amount of ice cubes in tank 12 is more than the predetermined amount after the series of the bagging operations, the switch S1 is maintained in its operated position to repeat the series of the bagging operations. If the stored amount of ice cubes in tank 12 becomes less than the predetermined amount, the switch S1 becomes inoperative to stop the series of the bagging operations.

In this embodiment, the grasping force of the bag during the bag feeding process can be increased by adjustment of the clamping mechanisms **30*a*, 30*b*. In addition, the process of feeding the foremost bag in the stored bags in the bag storage mechanism 20 and deploying the upper opening of the bag is carried out by the bag feeding mechanism 30 and the bag support mechanism 40. The bag feeding mechanism 30 is located under the ice delivery chute 11 and opposed to the bag storage mechanism 20. The bag feeding mechanism 30 is provided at its upper portion with the clamping mechanisms 30*a*, 30*b* for grasping the upper front side portion of the bag and is swingably mounted at its lower end to be moved toward and away from the bag storage mechanism 20 for feeding the bag under the ice delivery chute 11. The bag support mechanism 40 is provided with the support rods 43, 44 which are arranged to support the bag at its attachment portion Fa and is cooperable with the clamping mechanisms 30*a*, 30*b* for deploying the upper opening of the bag. With such an arrangement of the bag feeding mechanism 20 and the bag support mechanism 40**, the bagging apparatus can be manufactured in a simple construction at a relatively low cost.

In this embodiment, the series of the bagging operations are carried out only in a condition where presence of the predetermined amount of ice cubes in tank 12 is detected by the switch S1. It is, therefore, able to avoid shortage of the ice cubes during the bagging operations. Furthermore, the mounting screw 72 in the measuring mechanism 70 is provided to apply a predetermined load to the compression coil spring 73 for preventing the receiving plate 71 from its unwanted movements and for minimizing a displacement amount of the receiving plate 71 until the switches S12 and S13 are operated. The measurement of the bagged ice cubes is carried out in such a manner that after measurement at the first stage the base member 61 is moved upward to the horizonal position shown in FIG. 14 to lift the bag and loose it for preventing the load of the bagged ice cubes from acting on the clamping mechanisms 30*a*, 30*b* and the support rods 43, 44. This is useful to ensure accurate measurement of the bagged ice cubes.

Figure 15A:
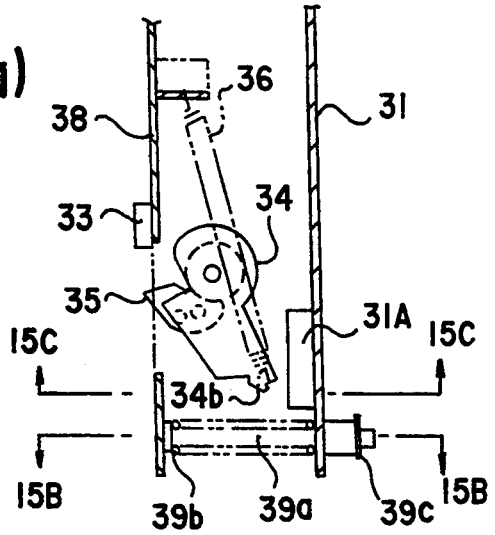
FIG. 15(*a*) illustrates a modification of the clamping mechanism in the bag feeding mechansim.
Figure 15B:
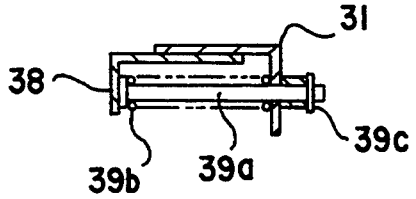
Figure 15C:
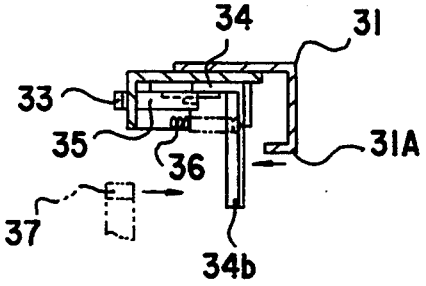

Although in the above embodiment the component parts of the respective clamping mechanisms 30*a*, 30*b*, namely the stationary pawl 33, swingable lever 34, movable pawl 35 and turnover spring 36 are mounted on the upper portion of arch-shaped tiltable frame 31 in such a manner that the swingable lever 34 is rotated by abutment against the bag at its operation arm 34*a* to engage the movable pawl 35 with the stationary pawl 33 for grasping the upper front side portion of the bag, the same component parts of the respective clamping mechanisms 30*a*, 30*b* may be mounted on a movable plate 38 assembled with the upper portion of tiltable frame 31 as shown in FIGS. 15(*d*)–15(*c*). In this modification, the movable plate 38 is movably assembled with the upper portion of tiltable frame 31 by means of a pin 39*a*, a coil spring 39*b* and a clip 39*c*. The pin 39*a* is fixed to the movable plate 38 at its one end and is axially slidably assembled with the upper portion of tiltable frame 31 at its other end. The coil spring 39*b* is arranged in surrounding relationship with the pin 39*a* to bias the movable plate 38 away from the tiltable frame 31. The clip 39*c* is fixed to the other end of pin 39*a* to prevent the pin 39*a* from coming off forward. Assuming that the stationary pawl 33 has been brought into engagement with the first bag F in the stored bags in forward movement of the tiltable frame 31, the upper portion of tiltable frame 31 is pushed toward the movable plate 38 against the biasing force of spring 39*b*. In this instance, the swingable lever 34 is rotated by abutment with a projection 31A of the tiltable frame 31 to engage the movable pawl 35 with the stationary pawl 33 for grasping the first bag F.

Figure 16B:
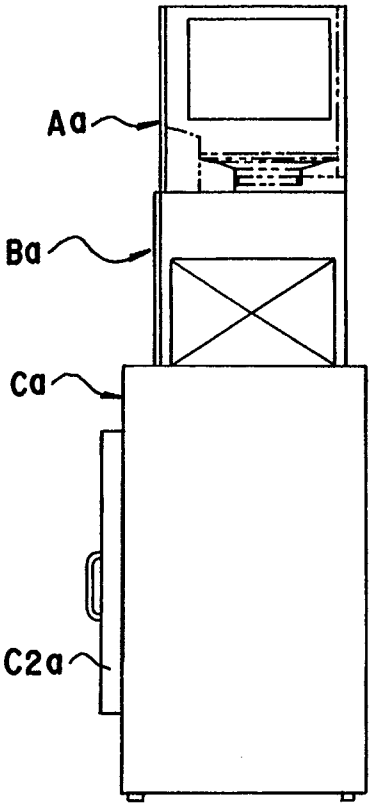
FIG. 16(*a*) is a partly broken front view of a second embodiment of an ice bagging apparatus according to the present invention.
Figure 16A:
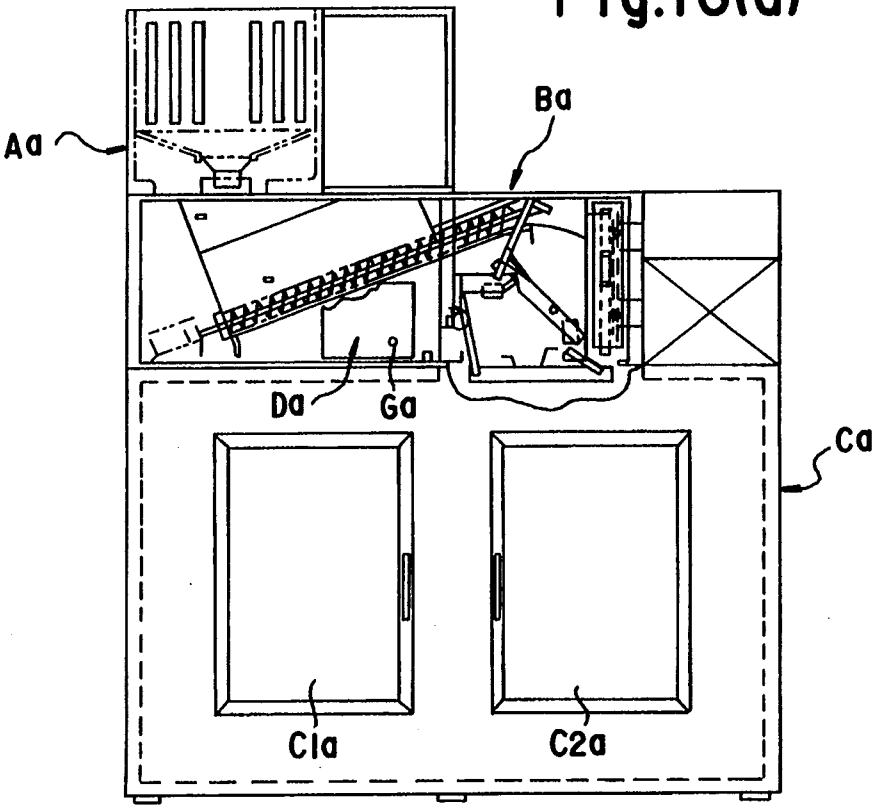

In FIGS. 16(*a*) and 16(*b*), there is illustrated a second embodiment of the present invention which comprises an ice making machine Aa, an ice bagging apparatus Ba according to the present invention, a stocker Ca provided at its front with a pair of doors C1a, C2a, and a control device Da for controlling operation of those components. The ice making machine Aa is the same as the ice making machine A of the first embodiment except that it has a different ice making performance, and the stocker Ca is likewise the same as the stocker C of the first embodiment except for a different storage capacity.

Figure 17:
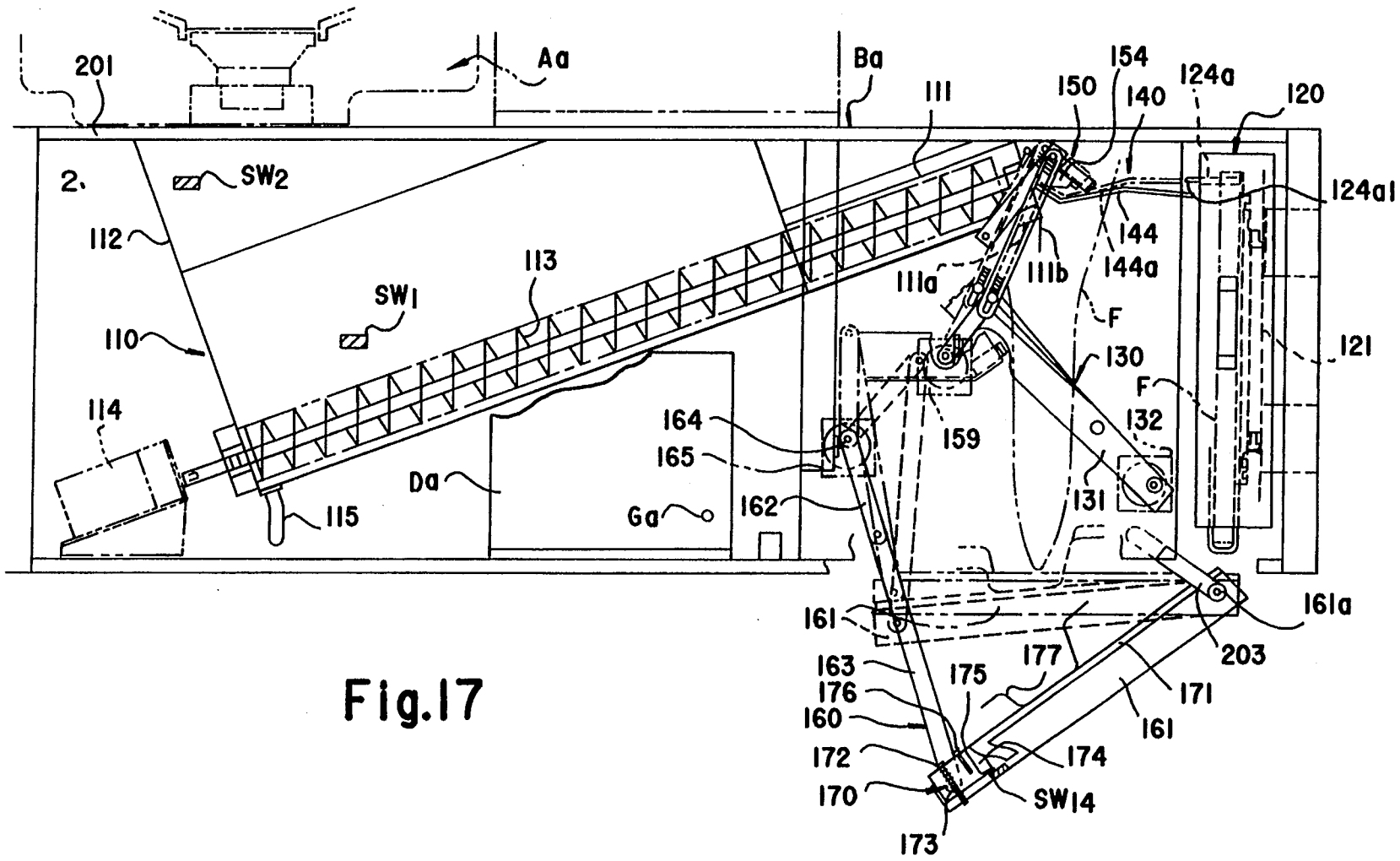
FIG. 17 is a partly broken front view in an enlarged scale of the second embodment.
Figure 18:
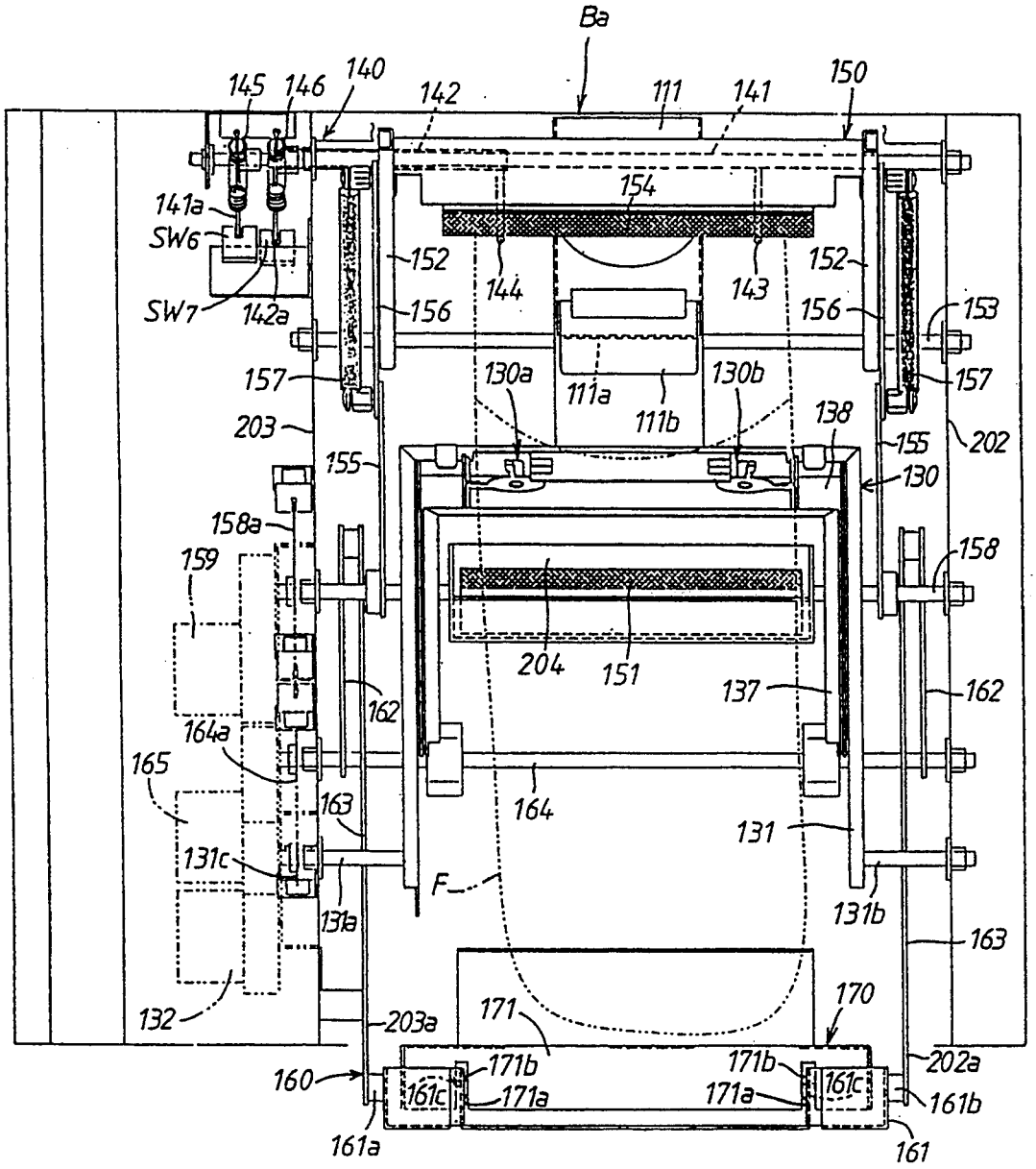
FIG. 18 is a vertical sectional view of the bagging apparatus shown in FIG. 17.

As shown in FIGS. 17 and 18, the bagging apparatus Ba comprises an ice storing/feeding mechanism 110 arranged to correspond with the ice discharge port of the ice making machine Aa, a bag storage mechanism 120 opposed to an ice delivery chute 111 of the ice storing/feeding mechanism 110 to store a number of stacked bags F, a bag feeding mechanism 130 arranged below the delivery chute 111 to successively feed a foremost bag of the stacked bags in the bag storage mechanism 120 to a predetermined position shown by imaginary lines in FIG. 17, a bag support mechanism 140 arranged above the bag feeding mechanism 130 and between the bag feeding mechanism 130 and the bag storage mechanism 120 to cooperate with the bag feeding mechanism 130 for supporting the first bag F thereon and deploying it under an outlet 111*a* of the ice delivery chute 111, a sealing mechanism 150 arranged to thermally seal the upper opening of the bag supplied with a predetermined amount of ice cubes, a tilting mechanism 160 arranged below the bag support mechanism 140 to slide the bagged ice cubes into the stocker Ca, and a measuring mechanism 170 integrally assembled with the tilting mechanism 160 to measure the weight of ice cubes supplied into the deployed bag.

As shown in FIG. 17, the ice storing/feeding mechanism 110 comprises a tank 112 integrally provided with the ice delivery chute 111 and mounted on a frame 201 to store the ice cubes supplied from the ice making machine Aa, an auger 113 rotatably mounted within the tank 112 to transport the stored ice cubes toward the delivery chute 111 from the bottom of tank 112, an electric motor 114 mounted on the frame 201 through a reduction gear to be operated under control of the control device Da for driving the auger 113, and a drain pipe 115 connected to the bottom of tank 112 to drain the water of melted ice outwardly. The tank 112 is provided at its lower and upper portions with optical switches SW1 and SW2 for detecting an amount of ice cubes stored in tank 112. A flapper 111*b* is hinged to the outlet 111*a* of the delivery chute 111 to direct the discharged ice cubes into the deployed bag F.

Figure 20:
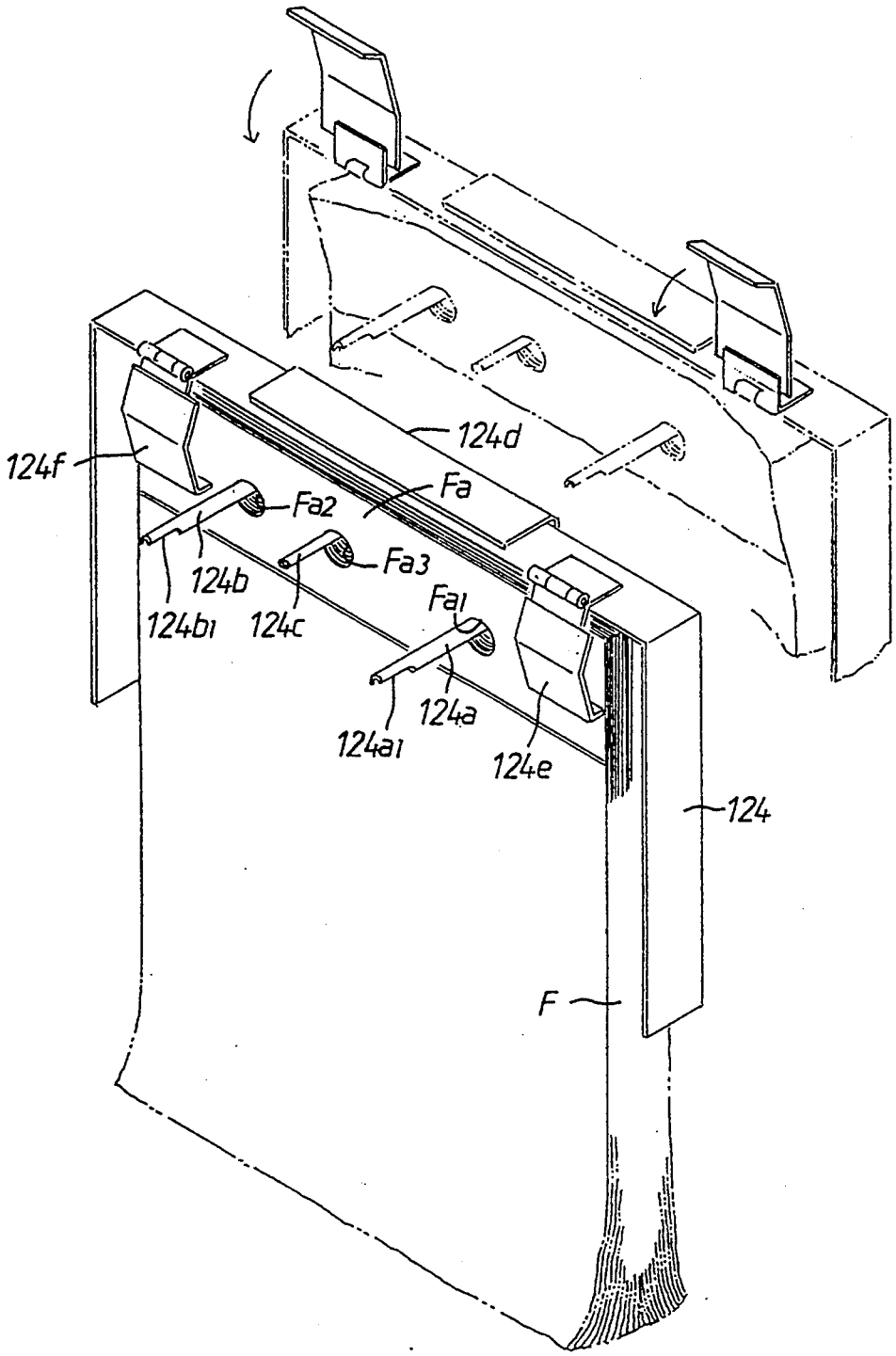
FIG. 20 is a perspective view showing a number of stacked bags stored in a cassette in the bag storage mechanism.

As shown in FIGS. 17, 19(*a*)–19(*c*) and 20, the bag storage mechanism 120 comprises an upright support plate 121 fixed to the frame 201, an intermediate slide plate 122 slidably assembled with the upright support plate 121 through a first slide rail mechanism, a slide plate 123 slidably assembled with the intermediate slide plate 122 through a second slide rail mechanism, and a cartridge 124 clearly shown in FIG. 20. The first slide rail mechanism includes a pair of parallel rails 129*a* and 129*b* fixed to the upright support plate 121, and a pair of parallel rails 129*e* and 129*f* fixed to the intermediate slide plate 122 and slidably coupled with the rails 129*a* and 129*b* through slide ball bearings 129*c* and 129*d*. The second slide rail mechanism includes a pair of parallel rails 128*a* and 128*b* fixed to the slide plate 123, a pair of spaced rollers 128*c* and 128*d* rotatably mounted on the front end portion of the intermediate slide plate 122 and engaged with the parallel rails 128*a* and 128*b*, and a pair of spaced rollers 128*g* and 128*h* rotatably mounted on the rear end portion of slide plate 123 and engaged with a pair of parallel rails 128*e* and 128*f* integrally formed with the upper and lower edges of intermediate slide plate 122. As shown in FIG. 20, the cartridge 124 has an upper end portion provided at its front portion with a pair of hollow support pins 124*a* and 124*b* and a positioning pin 124*c*. The hollow support pins 124*a*, 124*b* are formed at their lower portions with slits 124*a*1 and 124*b*1 as in the first embodiment. The upper portion of cartridge 124 is provided at its rear side with a hook to be engaged with a recess 123*a* formed in the upper end of slide plate 123. In the bag storage mechanism 120, a number of stacked bags F are hung on the support pins 124*a*, 124*b*, 124*c* of cartridge 124 as in the first embodiment to be successively taken out. (see FIG. 20) In addition, a maximum slide amount of the intermediate slide plate 122 relative to the support plate 121 is determined by a first stopper mechanism (not shown), and a maximum slide amount of the slide plate 123 relative to the intermediate slide plate 122 is determined by a second stopper mechanism composed of a stopper screw 127*a* threaded into the intermediate slide plate 122 and a stopper piece 127*b* secured to the rear end of slide plate 123.

As shown in FIGS. 19(*a*)–19(*c*) and 20, the cartridge 124 has a pair of weight plates 124*e* and 124*f* hinged to its upper end portion to prevent the upper corners of stacked bags F from warping. The slide plate 123 has a retainer plate of U-letter shaped cross-section attached to its lower end portion to prevent the lower portions of stacked bags Fa from warping and a handle 123*c* fixed to its one side end to be drawn outwardly. Provided between the other side end of slide plate 123 and a side of the frame 201 is a latch mechanism which is composed of latches 126*a* and 126*b* to position the slide plate 123 in place. In the bag storage mechanism 120, the cartridge 124 can be replaced with another one for supplement of bags by releasing the latch mechanism and drawing the slide plate 123 outwardly.

Figure 21:
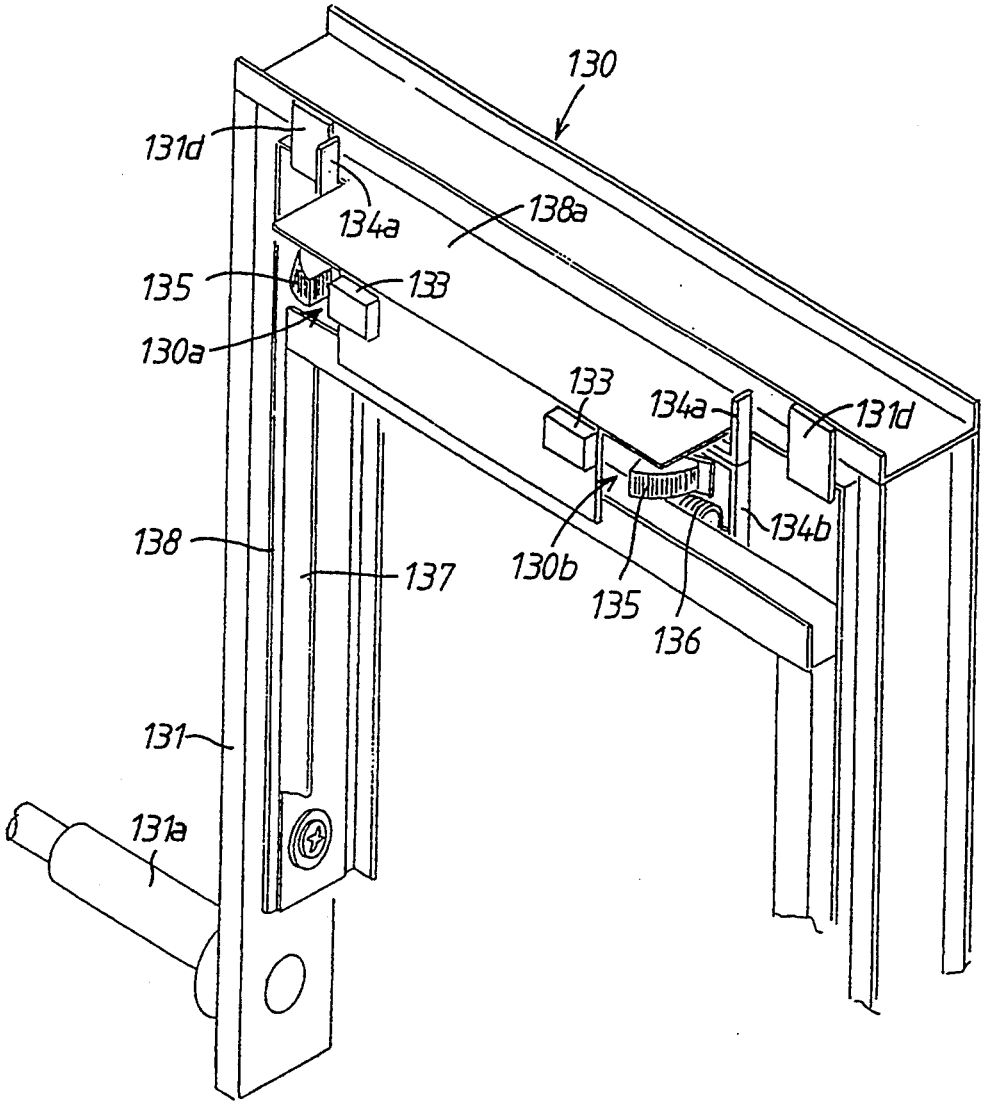
FIG. 21 is a perspective view of a bag feeding mechanism in the bagging apparatus illustrated from one side.
Figure 22:
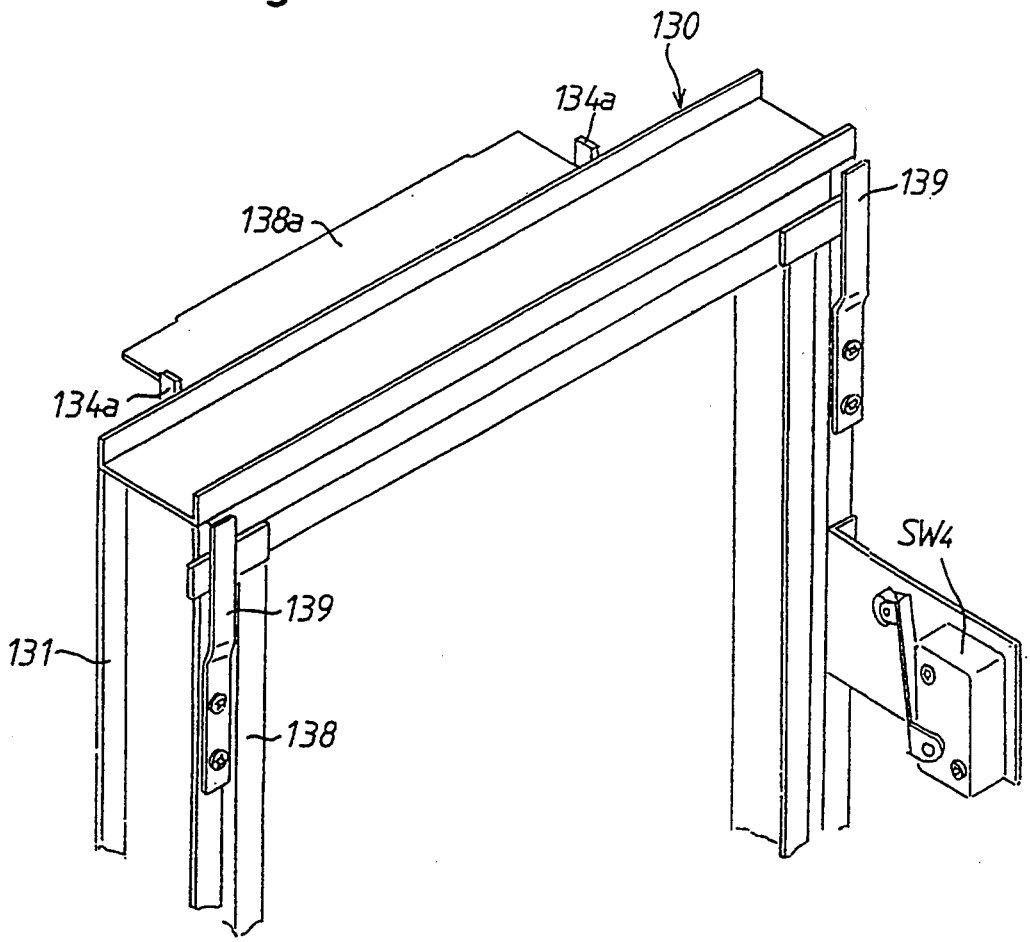
FIG. 22 is a perspective view of the bag feeding mechanism illustrated from the other side.
Figure 23:
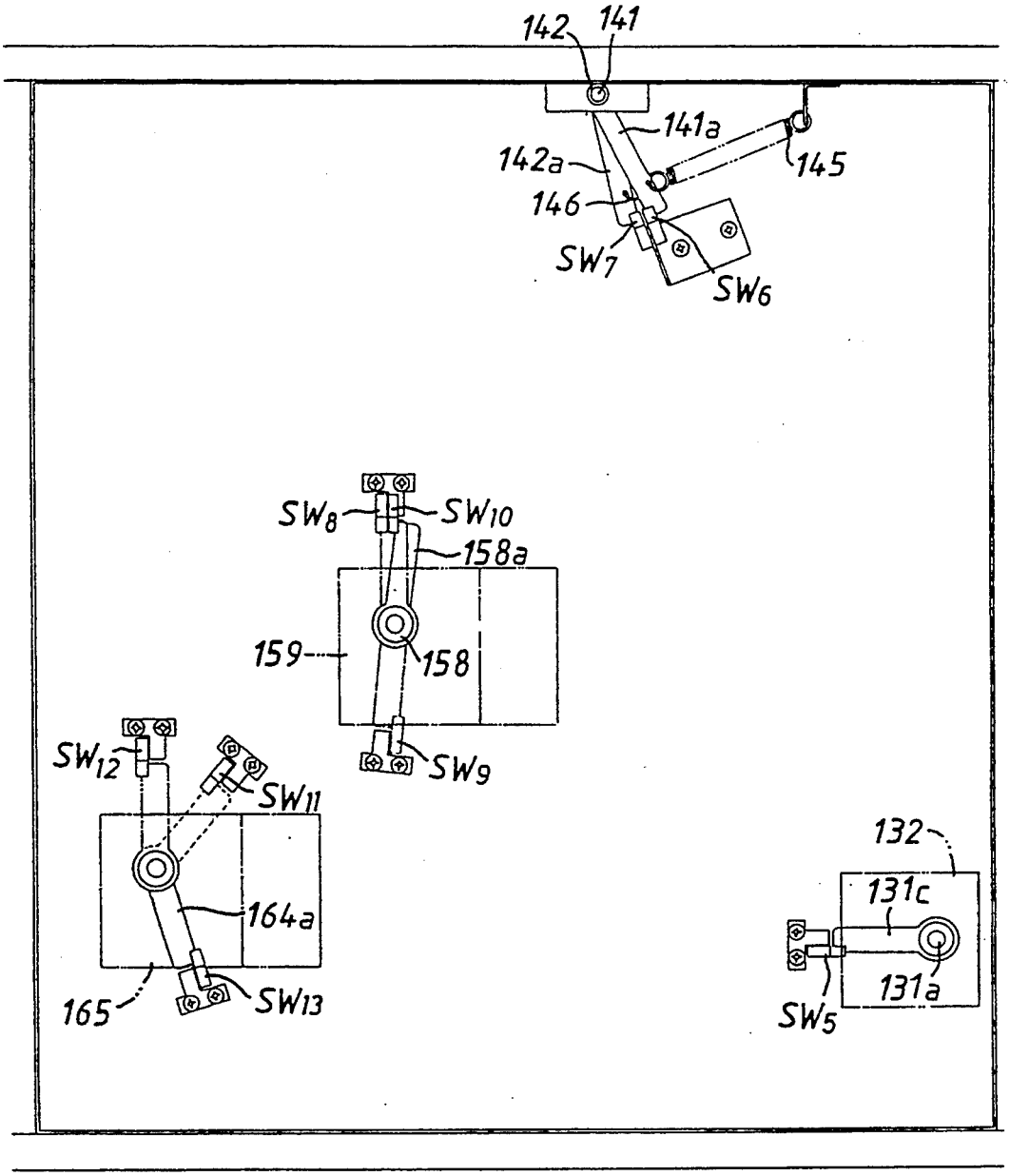
FIG. 23 is a view showing a relationship between individual electric motors and individual switches in the bagging apparatus.

As shown in FIGS. 17, 18, 21 and 22, the bag feeding mechanism 130 comprises an arch-shaped main frame 131 tiltably mounted on the side plates 202 and 203 of the frame 201 by means of a pair of axially spaced shafts 131*a* and 131*b* fixed to its lower end portion as shown in FIG. 18, a reversible electric motor 132 mounted on the side plate 203 through a reduction gear to be activated under control of the control device Da for tilting the tiltable main frame 131, an arch-shaped release lever 137 and an arch-shaped tiltable sub-frame 138 tiltably assembled with the tiltable main frame 131, a pair of clamping mechanisms 130*a* and 130*b* mounted on the upper portion of sub-frame 138, a touch switch SW4 mounted to the rear portion of tiltable main frame 131 as shown in FIG. 22 to detect the fact that the tiltable main frame 131 has been tilted in a predetermined amount toward the bag storage mechanism 120 with respect to the sub-frame 138, and an optical switch SW5 mounted on the side plate 203 as shown in FIG. 23 to cooperate with a detection plate 131*c* fixed to the shaft 131*a* for detecting the fact that the main frame 131 has been returned to its resting position. When the main frame 131 is tilted toward the bag storage mechanism 120, the sub-frame 138 is moved with the main frame 131 by engagement with a pair of leaf springs 139 fixed to the rear portion of main frame 131. When the main frame 131 is tilted toward its resting position, the sub-frame 138 is moved with the main frame 131 by engagement with a pair of projections 131d fixed to the front portion of main frame 131.

As shown in FIGS. 21 and 24(*a*)–24(*c*), each of the clamping mechanisms 130*a*, 130*b* comprises a stationary pawl 133 of rubber secured to the front side of an upper attachment plate 138*a* of the sub-frame 138, a swingable lever 134 rotatably pivoted to the upper attachment plate 138*a*, a movable pawl 135 of stainless steel integrally assembled with the swingable lever 134 to be engaged with the stationary pawl 133, and a turnover coil spring 136 connected at its opposite ends to the attachment plate 138*a* and the swingable lever 134 to bias the swingable lever 134 in a forward direction for pressing the movable pawl 135 against the stationary pawl 133 when engaged therewith as shown by imaginary lines in FIGS. 24(*a*)–24(*c*) and to bias the swingable lever 134 in a reverse direction when the movable pawl 135 has been disengaged from the stationary pawl 133 as shown by solid lines in FIG. 24(*a*). The movable pawl 135 has a serrated semi-circular portion for engagement with the bag to be grasped. As shown in FIGS. 21 and 24(*a*)–24(*c*), the swingable lever 134 is integrally formed with an operation arm 134*a* and a return arm 134*b*. The operation arm 134*a* of lever 134 is arranged to rotate the swingable lever 134 in the forward direction by abutment with the main frame 131 when the main frame 131 is further tilted toward the stored bags in a condition where the stationary pawl 133 is in contact with the foremost bags of stacked bags. The return arm 134*b* of lever 134 is arranged to rotate the swingable lever 134 in the reverse direction by abutment with the release lever 137 immediately before the first bag is sealed by the sealing mechanism 150.

As shown in FIGS. 17, 18, 23, 26(*a*)–26(*b*) and 27, the bag support mechanism 140 comprises a solid shaft 141 rotatably mounted on the side plates 202 and 203 of the frame 201, a hollow shaft 142 rotatably coupled over one side portion of the shaft 141 and mounted on the side plate 203, a pair of parallel bag support rods 143 and 144 respectively fixed at their one ends to the shafts 141 and 142, tension coil springs 145 and 146 for biasing the shafts 141 and 142 and bag support rods 143 and 144 counterclockwisely in FIG. 7, and stopper pieces 143*a* and 144*a* integrally formed with the respective bag support rods 143 and 144 to retain the bag F in a predetermined position by engagement to its attachment portion Fa.

When a heat seal bar 154 of the sealing mechanism 150 is in its resting position as shown in FIG. 17, the bag support rods 143 and 144 are carried by the heat seal bar 154 at a position spaced in a predetermined distance from the support pins 124*a*, 124*b* of the bag storage mechanism 120 to avoid interference in replacement of the cartridge 124. When the heat seal bar 154 is rotated to its upper dead point as shown by imaginary lines in FIG. 17, the bag support rods 143, 144 are maintained in engagement with the support pins 124*a*, 124*b* of the bag storage mechanism 120 under the load of tension springs 145, 146. When the heat seal bar 154 is rotated to its lower dead point, the bag support rods 143, 144 are moved downward by engagement with the heat seal bar 154 or a push lever 154*a* fixed thereto against the load of tension springs 145, 146 and disengaged from the support pins 124*a*, 124*b* of the bag storage mechanism 120. (see FIG. 27)

Figure 26A:
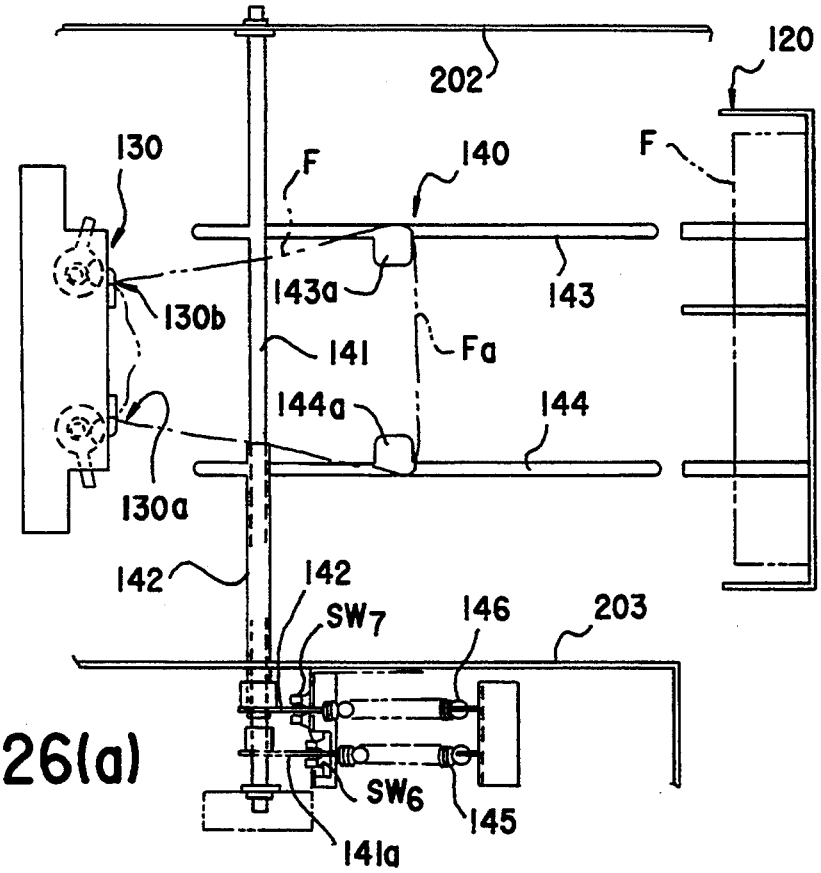
FIG. 26(*a*) is a plan view of a bag support mechanism in the bagging apparatus.
Figure 26B:
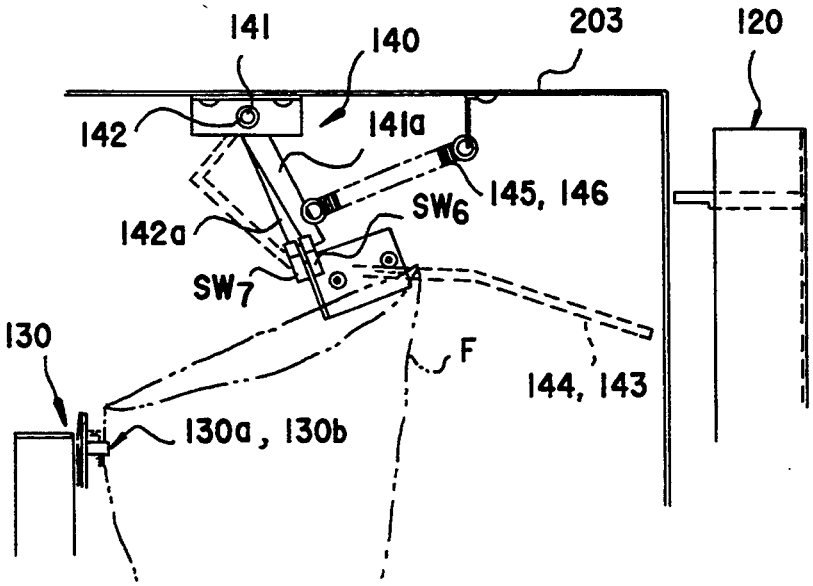

As shown in FIGS. 26(*a*) and 26(*b*), the bag support mechanism 140 is provided with optical switches SW6 and SW7. The optical switches SW6 and SW7 are mounted on the side plate 203 by means of a bracket to cooperate with rotary detection plates 141*a*, 142*a* respectively fixed to the shafts 141, 142 for detecting the fact that the bag F has been hung on the bag support rods 43, 144 at the predetermined position and slightly stretched by the clamping mechanisms 130*a*, 130*b* of the bag feeding mechanism 130.

Figure 27:
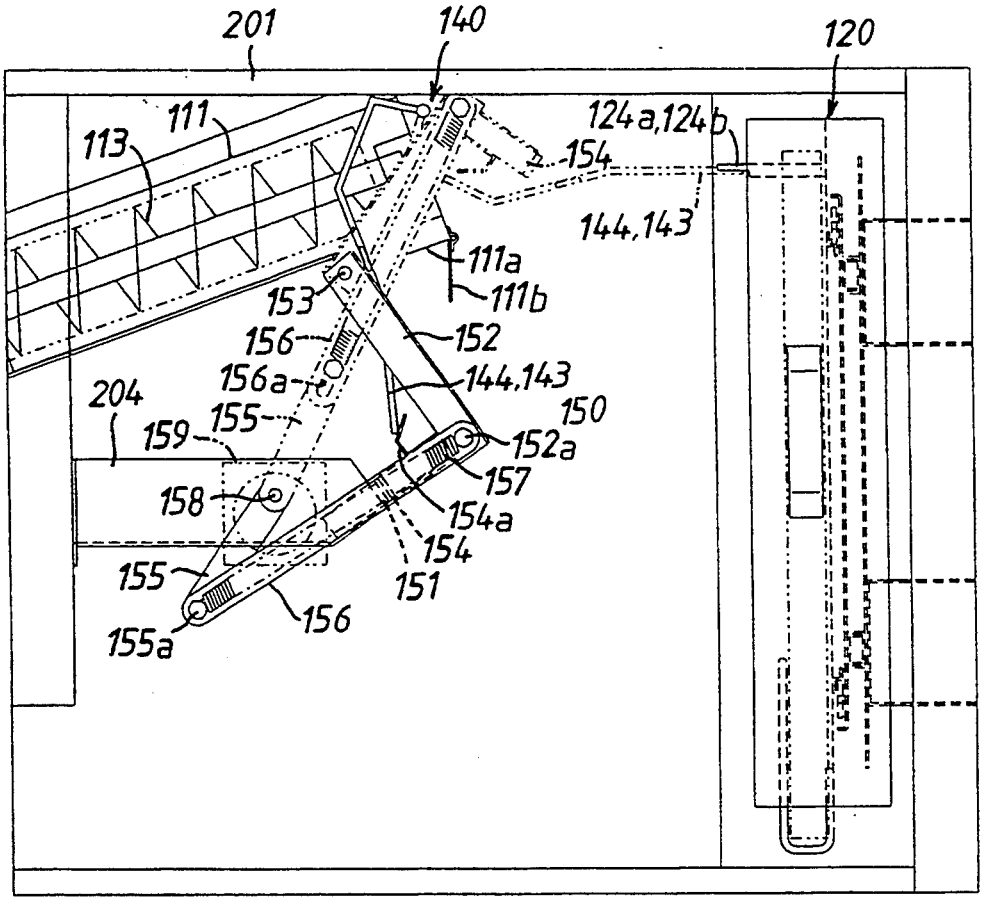
FIG. 27 is a view illustrating mainly a sealing mechanism in the bagging apparatus.

The sealing mechanism 150, substantially the same as the sealing mechanism 50 of the first embodiment, is provided to thermally seal the upper opening of the bag F supplied with a predetermined amount of ice cubes. As shown in FIGS. 17, 18 and 27, the sealing mechanism 150 comprises a heater block 151 mounted on the frame 201 by means of a lateral bracket 204, the arch-shaped heat seal bar 154 rotatably mounted on the side plates 202,203 of the frame 201 by means of a pair of axially spaced support arms 152 and a single support shaft 153, a drive shaft 158 rotatably mounted on the side plates 202, 203 and operatively connected to the support arms 152 by means of a pair of axially spaced drive arms 155, a pair of axially spaced linkages 156 and a pair of tension coil springs 157, a reversible electric motor 159 mounted on the side plate 203 through a reduction gear to be operated under control of the control device Da for driving the drive shaft 158, and optical switches SW8, SW9 and SW10 mounted on the side plate 203 as shown in FIG. 23. The optical switch SW8 is arranged to cooperate with a detection plate 158*a* fixed to the drive shaft 158 for detecting the fact that the drive arms 155 have been moved to their upper dead points. The optical switch SW9 is arranged to cooperate with the detection plate 158*a* for detecting the fact that the drive arms 155 have been moved to their lower dead points, and the optical switch SW10 is arranged to cooperate with the detection plate 158*a* for detecting the fact that the drive arms 155 have been returned to their resting positions.

Figure 28:
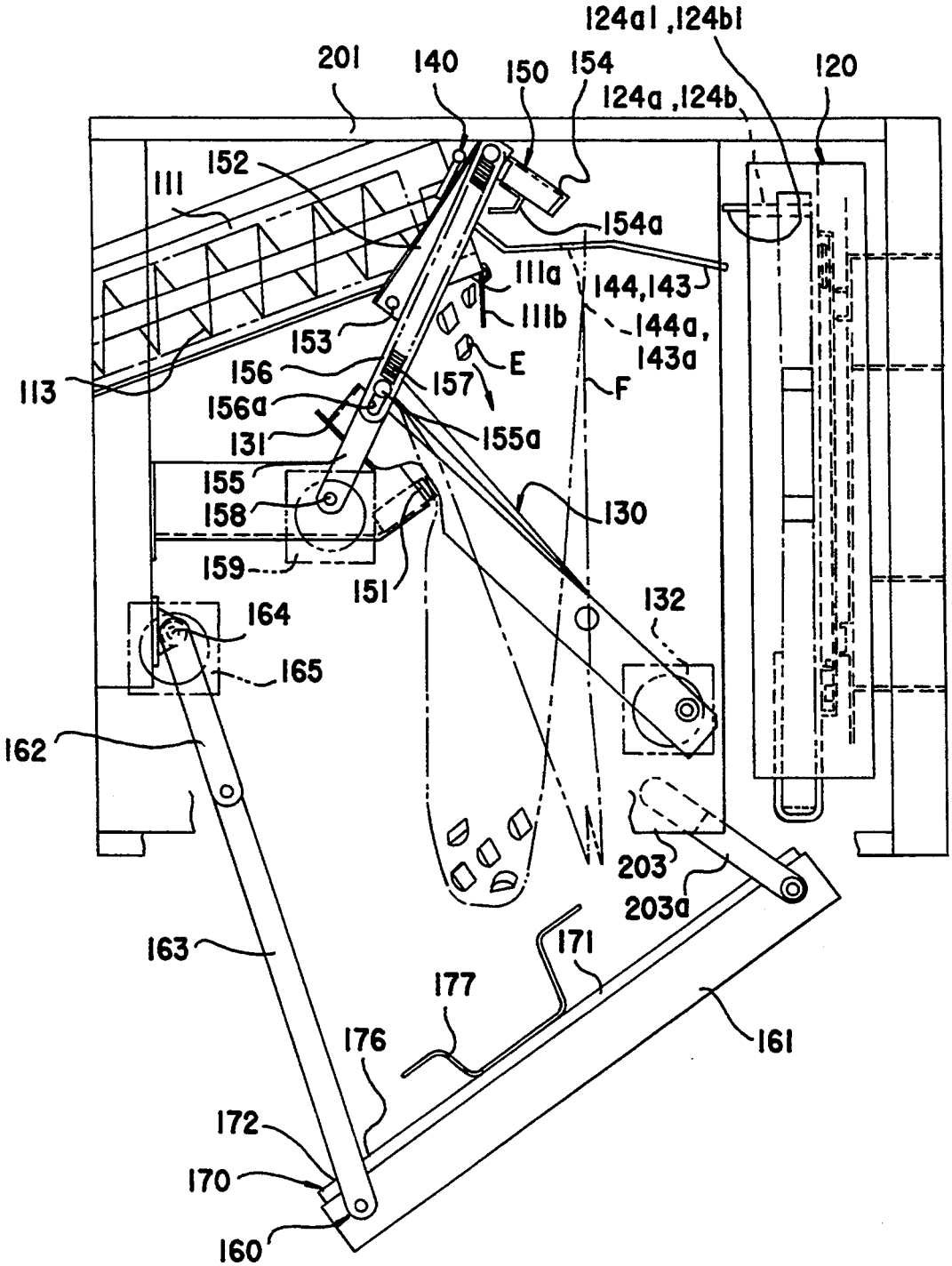
FIG. 28 illustrates a condition where the bag feeding mechanism has been operated to feed a bag under the ice delivery chute as shown by an imaginary line.

As shown in FIG. 28, each of the linkages 156 has an elongated hole 156*a* through which it is engaged with a pin 155*a* fixed to the free end of drive arm 155 to permit slight rotation of the drive arm 155 when the heat seal bar 154 has been brought into engagement with the heater block 151 as shown in FIG. 27. Each of the tension coil springs 157 has one end engaged with the pin 155*a* and the other end engaged with a pin 152*a* which interconnects the support arm 152 and linkage 156. When the drive arm 155 is further rotated in a condition where the heat seal bar 154 has been brought into engagement with the heater block 151, the coil spring 157 acts to bias the heat seal bar 154 toward the heater block 151.

As shown in FIGS. 17 and 18, the tilting mechanism 160, substantially the same as the tilting mechanism 60 of the first embodiment, comprises a base member 161 rotatably mounted on the side plates 202, 203 by means of a pair of axially spaced shafts 161*a*, 161*b* secured to its one end and a pair of brackets 202*a*, 203*a*, two pairs of spaced linkages 162, 163 arranged to support the other end of base member 161 movably in a vertical direction, a drive shaft 164 rotatably mounted on the side plates 202, 203 and connected to one ends of the linkages 162, a reversible electric motor 165 mounted on the side plate 203 through a reduction gear to be activated under control of the control device Da for rotating the drive shaft 164. As shown in FIG. 23, the tilting mechanism further comprises optical switches SW11, SW12 and SW13 mounted on the side plate 203. The optical switch SW11 is arranged to cooperate with a detection plate 164*a* fixed to the drive shaft 164 for detecting the fact that the drive shaft 164 has been rotated in a first predetermined amount to lift the base member 161 as shown by dotted lines in FIG. 17. The optical switch SW12 is arranged to cooperate with the detection plate 164*a* for detecting the fact that the drive shaft 164 has been rotated in a second predetermined amount to lift the base member 161 as shown by imaginary lines in FIG. 17. The optical switch SW13 is arranged to cooperate with the detection plate 164*a* for detecting the fact that the drive shaft 164 has been returned to its resting position to retain the base member 161 as shown by solid lines in FIG. 17.

The measuring mechanism 170, substantially the same as the measuring mechanism 70 of the first embodiment, is provided to measure a predetermined amount of ice cubes to be bagged. As shown in FIGS. 17 and 18, the measuring mechanism 170 comprises a receiving plate 171 movably assembled with the base member 161, a mounting screw 172 adjustably threaded into the base member 161 through a front end portion of receiving plate 171 to restrict upward movement of the receiving plate 171 relative to the base member 161, a compression spring 173 disposed between the base member 161 and receiving plate 171 in surrounding relationship with the mounting screw 172 to bias the receiving plate upward with a predetermined load, a detection plate 174 mounted to the front end portion of receiving plate 171 through a leaf spring 175 in such a manner as to be adjutable in a vertical direction, an adjusting screw 176 threaded into the front portion of receiving plate 171 for support of the leaf spring 175, and a support plate 177 of U-letter shaped cross-section mounted on the receiving plate 171 to receive a bag supplied with ice cubes thereon and support it upright. The measuring mechanism 170 includes an optical switch SW14 mounted within the base member 161 to cooperate with the detection plate 174 for detecting the fact that the compression spring 173 has been depressed by a predetermined weight acting on the receiving plate 171.

Assuming that in operation a main switch Ga shown in FIGS. 16 and 17 has been operated, the ice making machine Aa and stoeker Ca are activated under control of the control device Da so that a predetermined amount of ice cubes is produced at each ice making cycle and fails into the tank 112 of the bagging apparatus Ba and that the interior of the stocker Ca is refrigerated at a temperature suitable for storing the bagged ice cubes. If an excessive amount of ice cubes is stored in the tank 112 due to abnormal operation of the bagging apparatus Ba (for instance, malfunction of some electric motor or mechanism), the switch SW2 is operated so that the ice making machine Aa is deactivated under control of the control device Da.

When the switch SW1 is operated by detection of the ice cubes supplied into the tank 112, the electric motor 159 of the sealing mechanism 150 is activated under control of the control device Da to move the heat seal bar 154 from its resting position to its upper dead point as shown by imaginary lines in FIG. 17. Thus, the bag support rods 143, 144 of the bag support mechanism 140 are slightly moved upward by the load of springs 145, 146 and engaged with the support pins 124*a*, 124*b* of the bag storage mechanism 120. When the heat seal bar 154 has been moved to its upper dead point, the switch SW8 is operated to deactivate the electric motor 159 under control of the control device Da and to activate the electric motor 132 of the bag feeding mechanism 130 thereby to tilt the main frame 131 toward the bag storage mechanism 120 from its resting position.

When the stationary pawls 133 of the bag feeding mechanism 130 are brought into engagement with a foremost bag of the stacked bags F as shown in FIG. 24(*a*), the sub-frame 138 is stopped while the main frame 131 is further tilted toward the bag storage mechanism 120. Thus, the operation arms 134*a* of levers 134 are pushed by abutment with the main frame 131 to rotate the swingable levers 134 so that the movable pawls 135 are engaged with the stationary pawls 133 to grasp the foremost bag of the stacked bags F. In this instance, the biasing forces of springs 136 are turned over to maintain the engagement of pawls 133 and 135 as shown by imaginary lines in FIG. 24(*a*), and the switch SW4 is operated to deactivate the electric motor 132 under control of the control device Da. Upon lapse of a predetermined time (for instance, one second), the electric motor 132 is activated under control of the control device Da to rotate in a reverse direction for tilting the main frame 131 toward its resting position.

Thus, the attachment portion of the first bag F grasped by the pawls 133, 135 is smoothly carried by the support rods 143, 144 at its mounting holes Fa1, Fa2 so that the upper opening of the bag F is widely deployed under the ice delivery chute 111 as shown by imaginary lines in the FIG. 28. In this instance, the attachment portion of bag F is positioned by abutment with the stopper pieces 143*a*, 144*a* on the support rods 143, 144, while the front side portion of the bag F is stretched by the clamping mechanisms 130*a*, 130*b* to deploy the upper opening of the bag. When the support rods 143, 144 are slightly moved downward against the springs 145, 146, the switches SW6, SW7 are operated.

When the main frame 131 of bag feeding mechanism 130 is returned to its resting position, the switch SW5 is operated to deactivate the electric motor 132 under control of the control device Da and to activate the electric motor 114 of the ice delivery mechanism 110 after the switches SW6, SW7 have been operated. Thus, the auger 113 is driven by the electric motor 114 to cause the ice cubes in tank 112 to fall into the deployed bag F through the ice delivery chute 111. When supplied with the ice cubes, the deployed bag F is slightly extended by the weight of ice cubes as shown in FIG. 28, and the support rods 143, 144 are further moved downward against the springs 145, 146 to render the switches SW6, SW7 inoperative.

Figure 29:
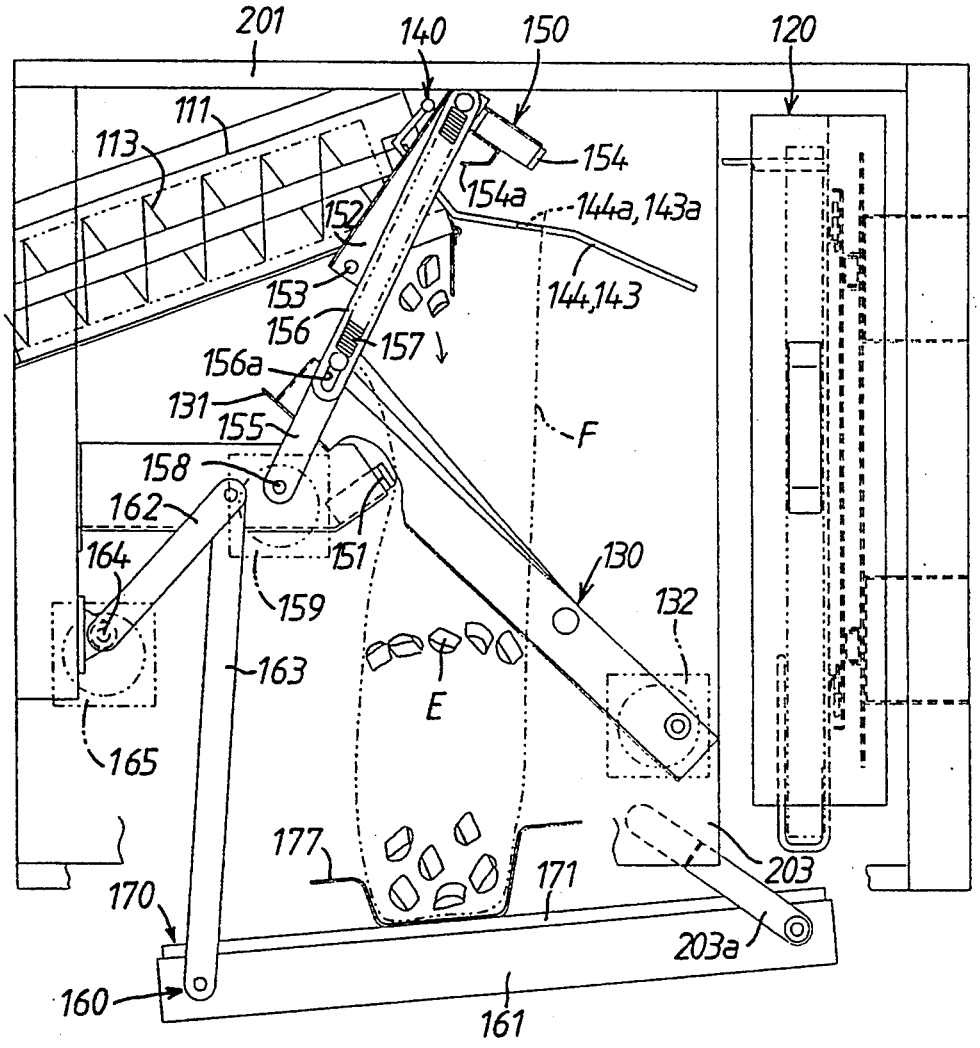
FIG. 29 illustrates a condition where about ⅔ of a predetermined amount of ice cubes has been supplied into the bag.

In such a condition as described above, the electric motor 165 of tilting mechanism 160 is activated under control of the control device Da to lift the base member 161 from its resting position. When the switch SW11 is operated by upward movement of the base member 161, the electric motor 165 is deactivated under control of the control device Da and maintained in its deactivated condition for about fifty seconds. Thus, the base member 161 is retained in a slightly inclined condition as shown in FIG. 29. During upward movement of the base member 161, the electric motor 114 of the ice delivery mechanism 110 is deactivated under control of the control device Da after lapse of five seconds and maintained in its deactivated condition for about fifteen seconds. Upon lapse of the fifteen seconds, the electric motor 114 is activated again under control of the control device Da to further supply the ice cubes into the bag F.

Figure 30:
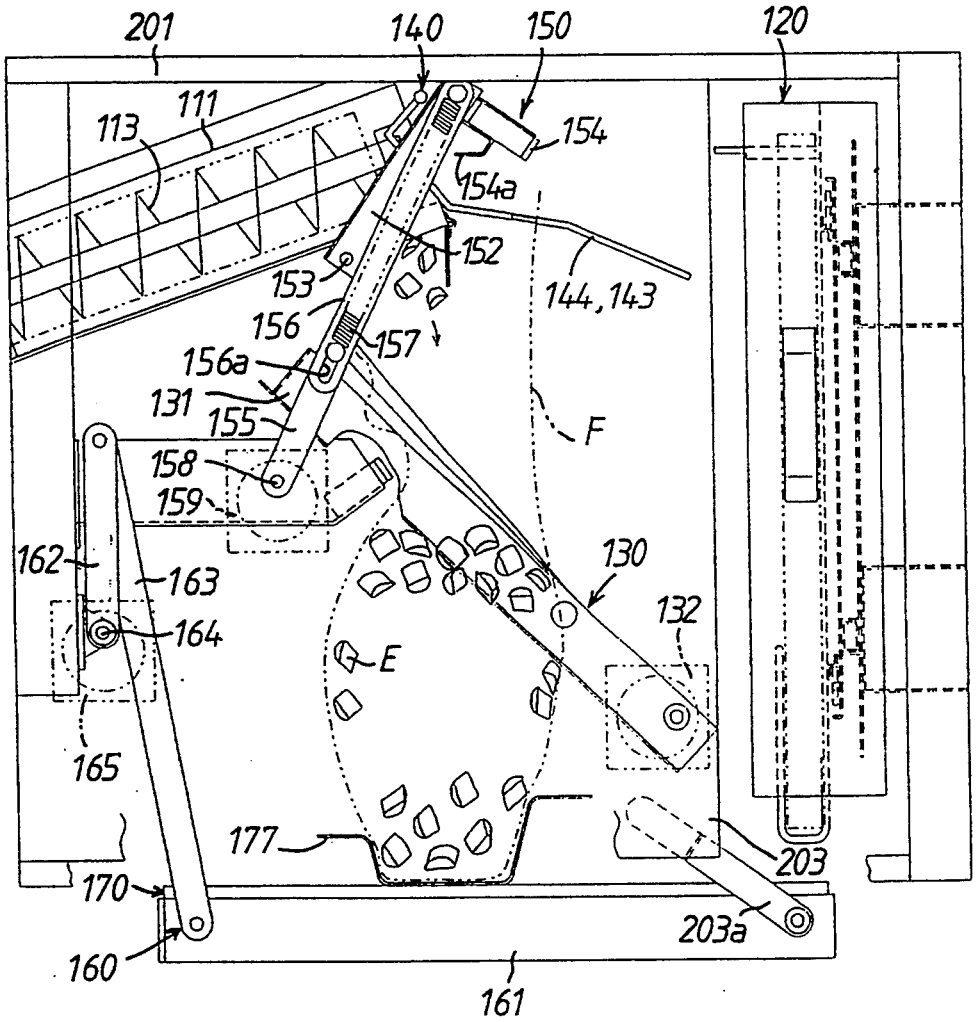
FIG. 30 illustrates a condition where the predetermined amount of ice cubes has been put in the bag.

Upon lapse of about fifty seconds after operation of the switch SW11, the bag F is supplied with about $\frac{2}{3}$ of the predetermined amount of ice cubes, and the electric motor 165 of tilting mechanism 160 is activated again under control of the control devce Da to further lift the base member 161. When the switch SW12 is operated by upward movement of the base member 161, the electric motor 165 is deactivated under control of the control device Da to stop the upward movement of the base member 161. In this instance, the base member 161 is retained in a horizontal position as shown in FIG. 30. When the bag F is supplied with the predetermined amount of ice cubes, the switch SW14 of the measuring mechanism 170 is operated to deactivate the electric motor 114 of the ice delivery mechanism 110 under control of the control device Da thereby to stop the ice delivery action of auger 113. Subsequently, the electric motor 159 of the sealing mechanism 150 is activated under control of the control device Da to rotate the drive shaft 158 in a forward direction thereby to move the drive arms 155 toward a predetermined position shown by imaginary lines in FIG. 27.

The movements of drive arms 155 are transmitted to the support arms 152 through the linkages 156. Thus, the support arms 152 are rotated to move the seal bar 154 toward the heater block 151, and the upper front side portion of the deployed bag F is clamped by the seal bar 154 and heater block 151. After the seal bar 154 has been engaged with the heater block 151, the rotation of support arms 152 is permitted by the elongated holes 156*a* of linkages 156 so that the seal bar 154 is biased toward the heater block 151 by means of the resilient force of springs 157. In this instance, the bag support rods 143, 144 are rotated counterclockwisely by engagement with the seal bar 154 or the presssing piece 154*a* against the biasing force of springs 145, 146 so that the attachment portion Fa of bag F slides on the support rods 143, 144 toward a position where the front side portion of bag F is grasped by the clamping mechanisms 130*a*, 130*b*. Simultaneously, as shown in FIGS. 25(*b*) and 25(*d*), the release lever 137 of the bag feeding mechanism 130 is rotated by engagement with the opposite ends of heat seal bar 154 to move the return arms 134*b* of swingable levers 134 against the springs 136 thereby to disengage the movable pawls 135 from the stationary pawls 133, resulting in release of the bag F from the clamping mechanisms 130*a*, 130*b*. In this instance, the movement of sub-frame 138 is blocked by the bracket to reliably move the return arms 134*b* of levers 134.

When the drive arms 155 are moved to the predetermined position, the optical switch SW9 of the sealing mechanism 150 is operated to deactivate the electric motor 159 under control of the control device Da, and the heater block 151 is energized for a predetermined time (for instance, 0.3 to 0.5 seconds) to thermally seal the upper opening of the bag F. Thereafter, the electric motor 159 of the sealing mechanism 150 is activated under control of the control device Da to rotate in the reverse direction for returning the component parts of the sealing mechanism 150 to their resting positions, and the electric motor 165 of the tiliting mechanism 160 is activated under control of the control device Da to rotate in the reverse direction for driving the drive shaft 164 in the reverse direction. Thus, the linkages 162 are moved downward to tilt the base member 161 downward for dropping the bagged ice cubes into the stocker Ca. When the bagged ice cubes fall into the stocker Ca, the bag support rods 143, 144 are rotated against the springs 145, 146 to release the attachment portion Fa of the bag F therefrom. When the drive shaft 164 of the tilting mechanism 160 is driven in the reverse direction to return the base member 161 to its resting position, the switch SW13 is operated to deactivate the electric motor 165 under control of the control device Da. When the component parts of the sealing mechanism 150 are returned to their resting positions, the switch SW10 is operated to deactivate the electric motor 159 under control of the control device Da.

If the stored amount of ice cubes in tank 112 is more than the predetermined amount after the series of the bagging operations, the switch SW1 is maintained in its operated position to repeat the series of the bagging operations. If the stored amount of ice cubes in tank 112 becomes less than the predetermined amount, the switch SW1 becomes inoperative to stop the bagging apparatus.

In this embodiment, the grasping force of the bag during the bag feeding process can be increased by adjustment of the clamping mechanisms 130*a*, 130*b*. In addition, the process of feeding a foremost bag of the stacked bags and deploying the upper opening of the bag is carried out by the bag feeding mechanism 130 and the bag support mechanism 140. The bag feeding mechanism 130 is located under the ice delivery chute 111 and opposed to the bag storage mechanism 120. The bag feeding mechanism 130 is provided at its upper portion with the clamping mechanisms 130*a*, 130*b* for grasping the front side portion of the bag and is tiltably mounted at its lower end to be moved toward and away from the bag storage mechanism 120 for feeding the bag under the ice delivery chute 111. The bag support mechanism 140 is provided with the support rods 143, 144 which are arranged to support the bag at its attachment portion Fa and is cooperable with the clamping mechanisms 130*a*, 130*b* for deploying the upper opening of the bag. With such an arrangement of the bag feeding mechanism 120 and the bag support mechanism 140, the bagging apparatus can be manufactured in a simple construction at a relatively low cost.

In this embodiment, the series of the bagging operations are carried out only in a condition where presence of the predetermined amount of ice cubes in tank 112 is detected by the switch SW1. It is, therefore, able to avoid shortage of the ice cubes during the bagging operations. Furthermore, the mounting screw 172 in the measuring mechanism 170 is provided to apply a predetermined load to the compression poll spring 173 for preventing the receiving plate 171 from its unwanted movements and for minimizing a displacement amount of the receiving plate 171 until the switch SW14 is operated. The measurement of the bagged ice cubes is carried out in such a manner that after measurement at the first stage the base member 161 is moved upward to the horizonal position shown in FIG. 30 to lift the bag and loose it for preventing the load of the bagged ice cubes from acting on the elamping mechanisms 130*a*, 130*b* and the support rods 143, 144. This is useful to ensure accurate measurement of the bagged ice cubes.

In this embodiment, the clamping mechanisms 130*a* and 130*b* are mounted on the sub-frame 138 in such a manner that when the main frame 131 is further moved toward the sub-frame 138 after engagement of the stationary pawls 133 with the foremost bag of the stacked bags F, the operation arm 134*a* of lever 134 is pushed by the main frame 131 to rotate the swingable lever 134 in the forward direction to permit the bag F to be held by the movable pawls 135 and the stationary pawls 133. With such an arrangement, the clamping mechanisms 130*a* and 130*b* do not operate before engagement with the foremost bag of the stacked bags F. This serves to prevent an error in operation of the clamping mechanisms.

Figure 31A:
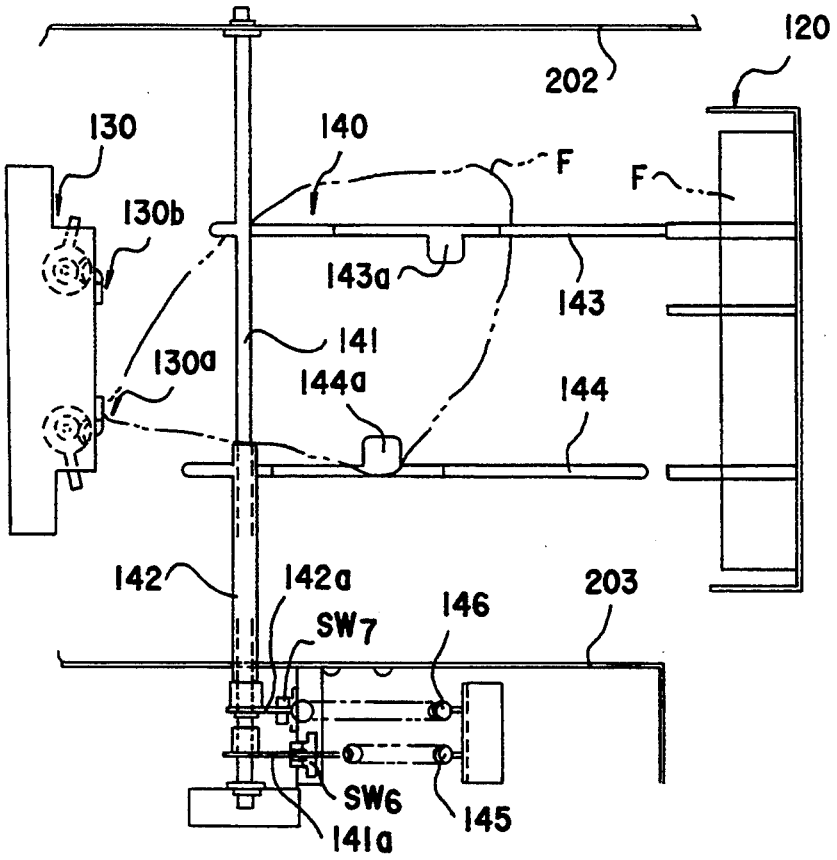
FIG. 31(*a*) illustrates a condition where the bag has not been accurately held by the clamping mechanism.
Figure 31B:
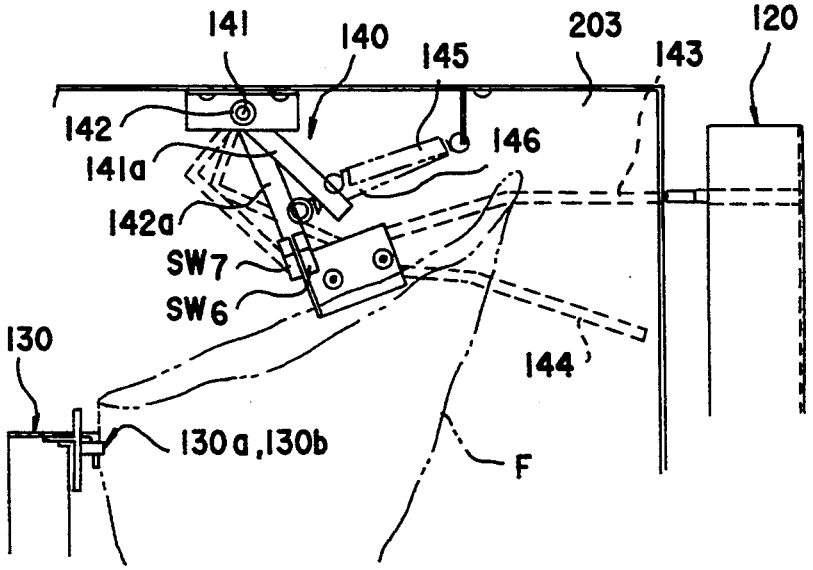

If in the bagging operation the bag F may not be properly grasped by the clamping mechanisms 130*a*, 130*b* as shown in FIGS. 31(*a*) and 31(*b*), the switch SW6 does not operate. Under such a condition, the electric motor 159 of sealing mechanism 150 is activated under control of the control device Da to rotate the drive shaft 158 in the forward direction thereby to move the drive arms 155 downward. As a result, the clamping mechanisms 130*a*, 130*b* are released to drop the bag therefrom. When the drive arms 155 are moved to the predetermined position shown by solid lines in FIG. 27, the switch SW9 is operated to deactivate the electric motor 159 of sealing mechanism 150 under control of the control device Da. After maintained in its deactivated condition for about one second, the electric motor 159 is activated under control of the control device Da to rotate in the reverse direction to return the components of sealing mechanism 150 to their resting positions. If in the bagging operation both the switches SW6 and SW7 do not operate due to no presence of the bags in the cartridge 124, an alarm lamp (not shown) is lighted after the above operation of the sealing mechanism 150, and the ice making machine Aa and bagging apparatus Ba are deactivated.

Figures 32A, 32B, 32C:
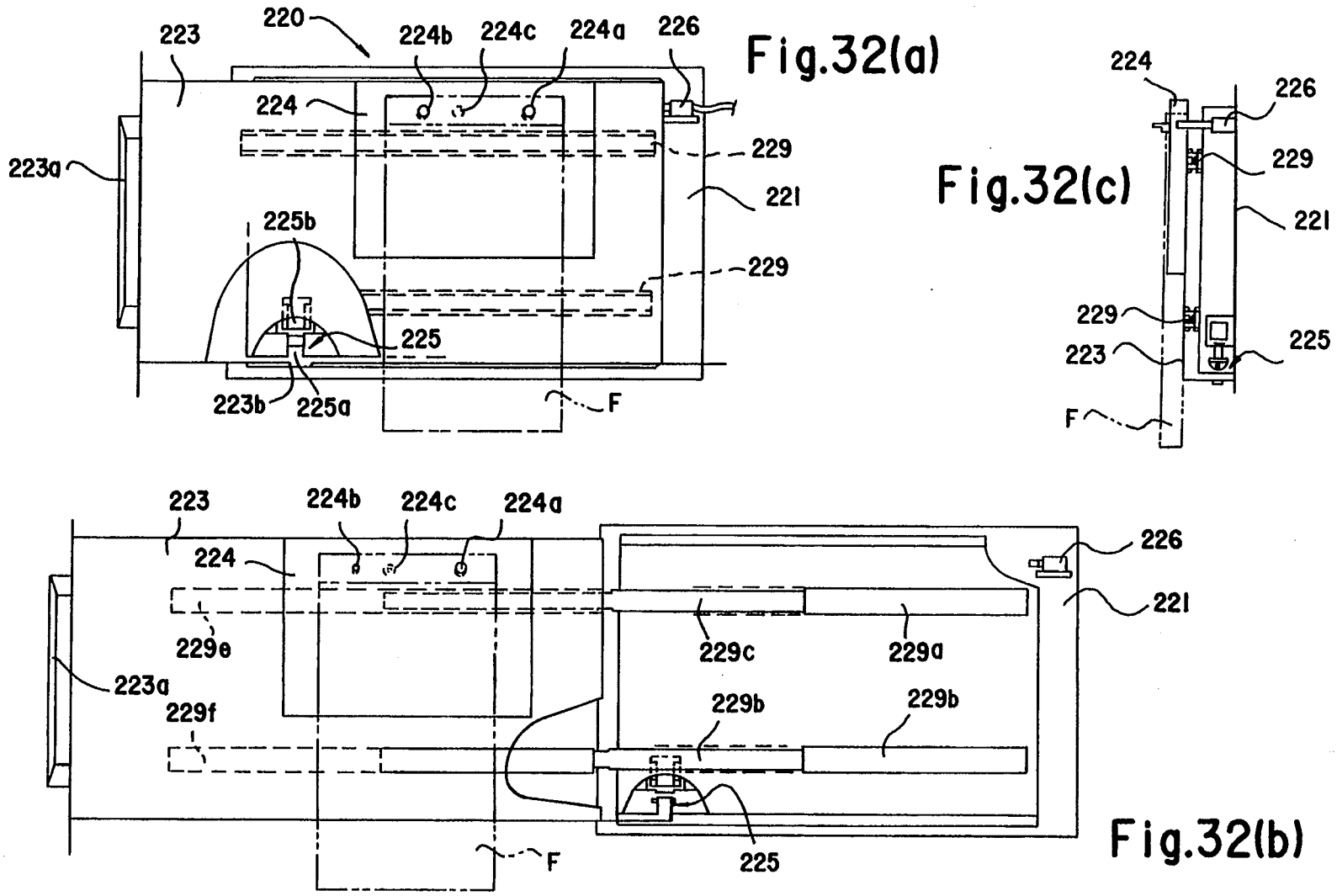
FIGS. 32*a*) and 32(*b*) each are a rear view of a modification of the bag storage mechanism in the bagging apparatus.
Figure 34:
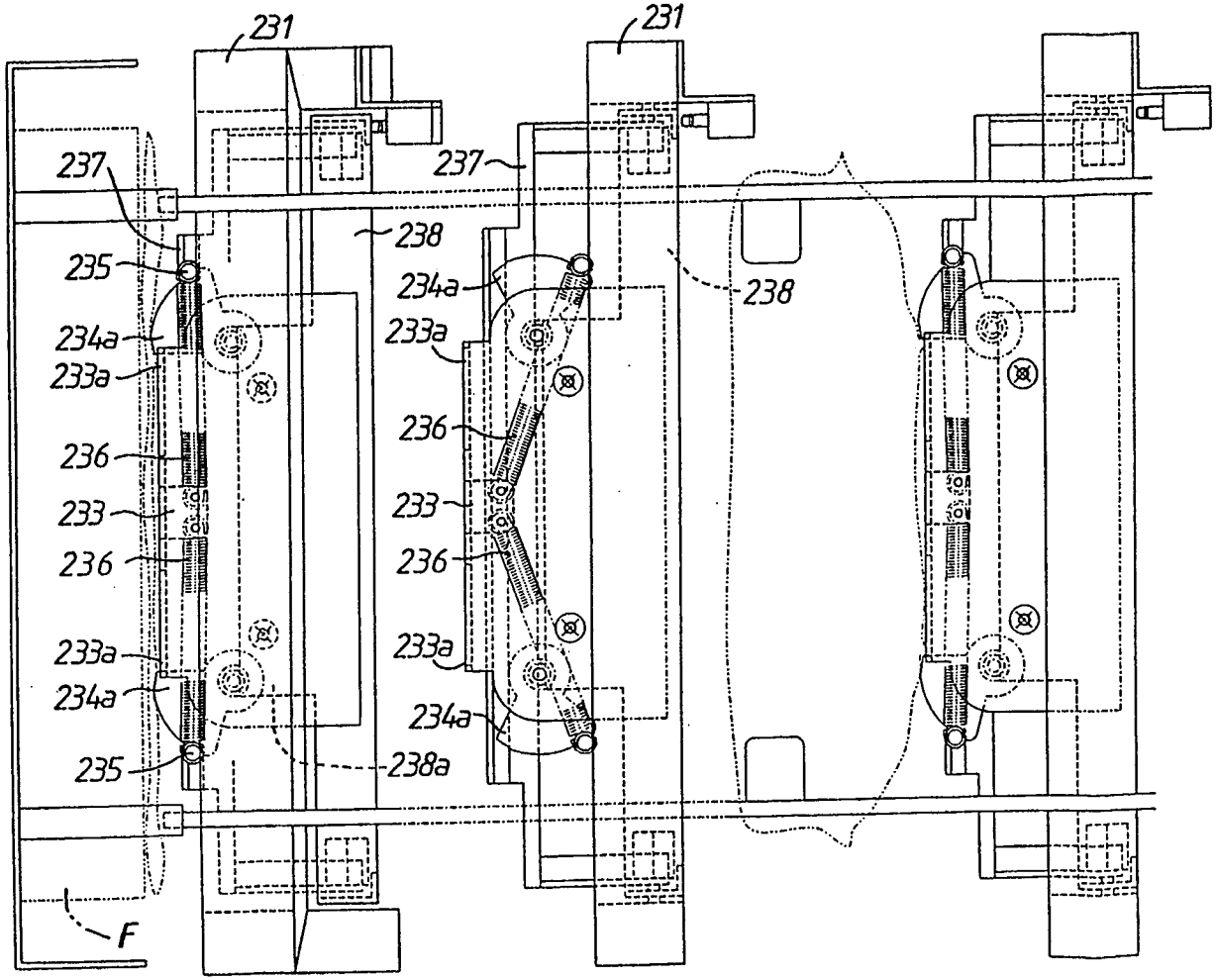
FIG. 34 is a plan view of the modification of the clamping mechanism.

In FIGS. 34(*a*)–32(*c*), there is illustrated a modification of the bag storage mechanism 120 shown in FIGS. 19(*a*)–19(*c*). The modified bag storage mechanism 220 in FIG. 32 comprises an upright support plate 221 fixedly mounted on the frame, a slide plate 223 assembled with the support plate 221 through a slide rail mechanism 229 to be slidable forward and having a handle 223*a* provided at its one side end, a cartridge 124 provided at its upper front portion with a pair of hollow support pins 224*a*, 224*a* and a positioning pin 224*c*, a locking mechanism 225 for locking the cartridge 224 in its resting position, and a switch 226. The slide rail mechanism 229 includes a pair of parallel rails 229*a* and 229*b* fixed to the support plate 221, a pair of parallel rails 229*c* and 229*d* slidably coupled with the rails 229*a* and 229*b*, and a pair of parallel rails 229*e* and 229*f* slidably coupled with the rails 229*c* and 229*d*. The hollow support pins 224*a* and 224*b* each are formed at their low portions with a slit. The locking mechanism 225 includes a lock pin 225*a* to be engaged with a hole 223*b* in the lower end portion of slide plate 223 and a solenoid 225*b* arranged to drive the lock pin 225*a* for engagement with the slide plate 223. When the cartridge 224 is in its resting position, the switch 226 cooperates with a manual unlock switch (not shown) to energize the solenoid 225*b* for disengaging the lock pin 225*a* from the slide plate 223. In the bag storage mechanism 220, a number of stacked bags F are hunged on the support pins 224*a*, 224*b* and 224*c* of cartridge 224 to be successively taken out. The maximum slide amount of slide plate 223 relative to the support plate 221 is determined by a stopper mechanism (not shown).

Figure 33:
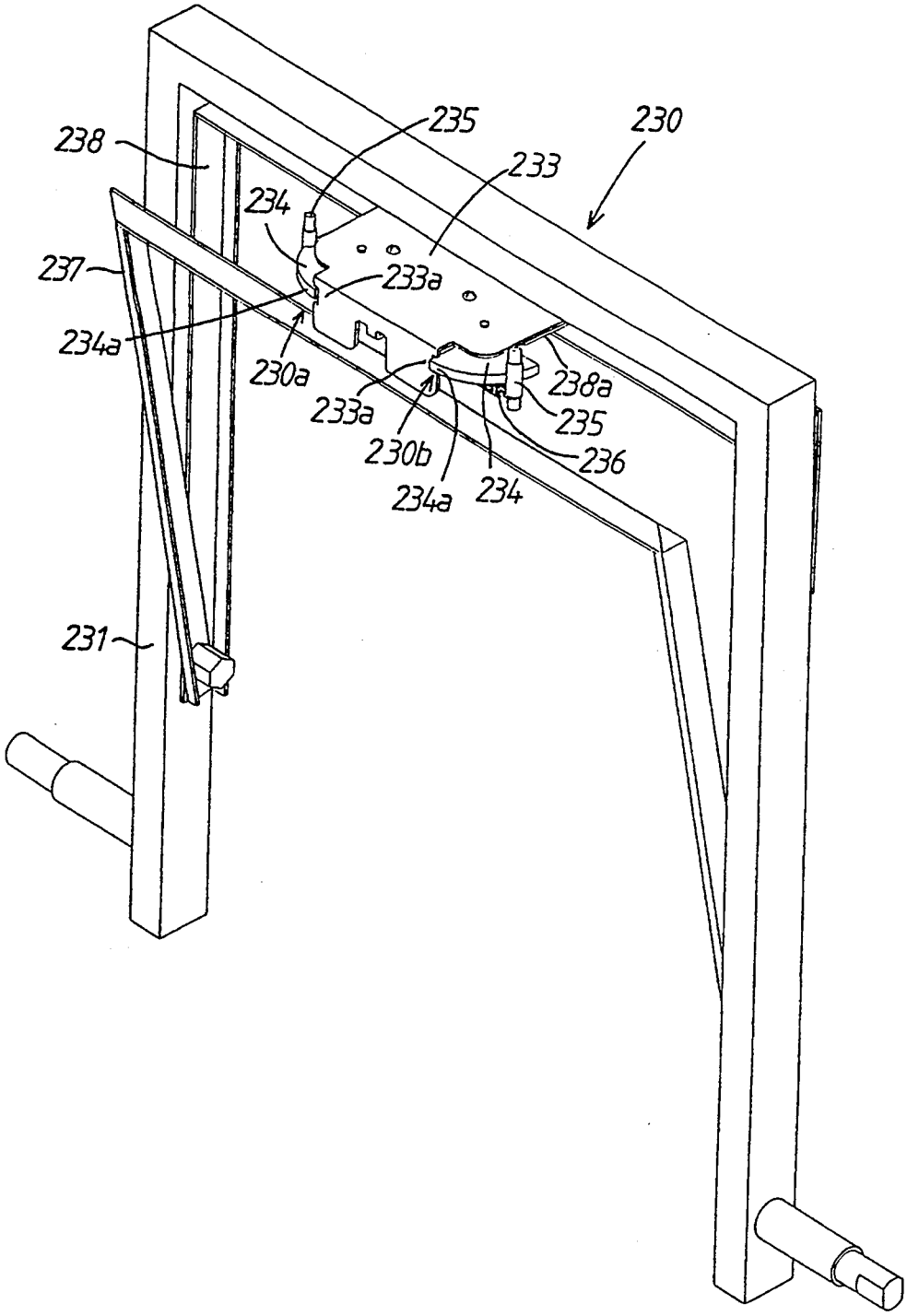
FIG. 33 is a perspective view of a modification of the clamping mechanism in the bagging apparatus.

In FIGS. 33 and 34, there is illustrated a modification of the clamping mechanisms 130*a*, 130*b* shown in FIGS. 21, 22 and 24(*a*)–24(*c*). The modified clamping mechanisms 230*a*, 230*b* shown in FIG. 33 each comprise an attachment plate 238*a* secured to the upper portion of an arch-shaped sub-frame 238, a stationary pawl 233*a* integrally formed with a stainless steel plate 233 secured to the attachment plate 238*a*, a movable pawl 234*a* integrally formed with a swingable lever 234 rotatably assembled with the stainless steel plate 233 to be engaged with or disengagd from the stationary pawl 233*a*, and a turnover spring 236 connected at its opposite ends to the plate 233 and a pin 235 fixed to the swingable lever 234. The movable pawl 234*a* has a serrated semicircular portion for engagement with the stationary pawl 233*a*. The turnover spring 236 is arranged to bias the swingable lever 234 in a forward direction when the movable pawl 234*a* is engaged with the stationary pawl 233*a* and to bias the swingable lever 234 in a reverse direction when the movable pawl 234*a* is disengaged from the stationary pawl 233*a* in a predetermined amount. When the main frame 231 of the bag feeding mechanism 230 is further tilted after the stationary pawl 233*a* has been engaged with the foremost bag of the stacked bags F, the pin 235 is moved by engagement with the main frame 231 to rotate the swingable lever 234 in the forward direction. When moved by engagement with an arch-shaped release lever 237 immediately before operation of the sealing mechanism, the pin 235 acts to rotate the swingable lever 234 in the reverse direction.

Figure 35:
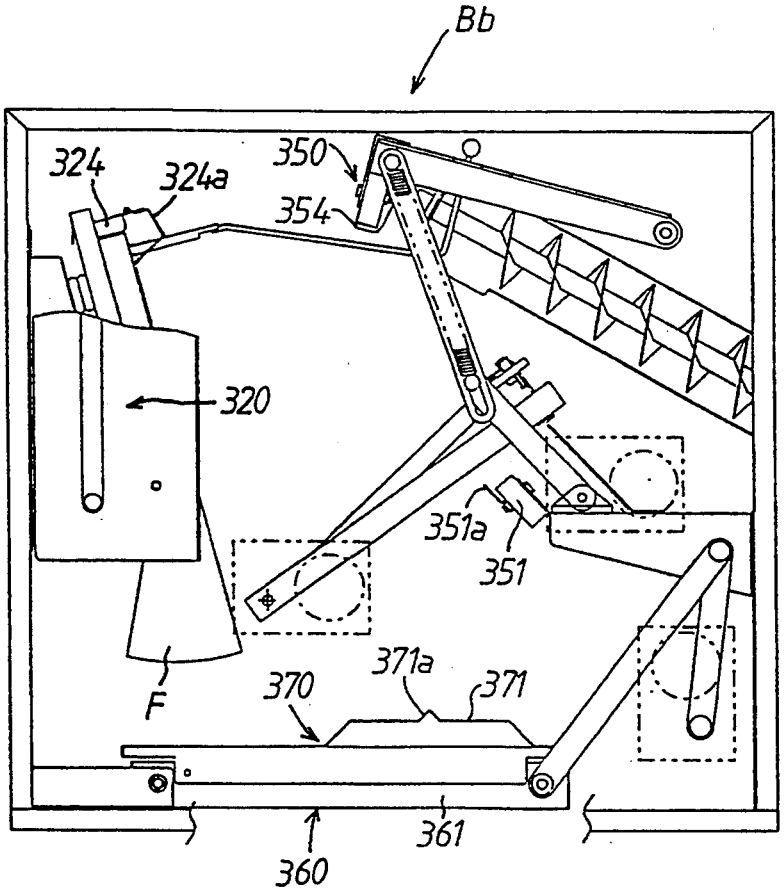
FIG. 35 is a partly broken front view of a further modification of the bagging apparatus.
Figure 36:
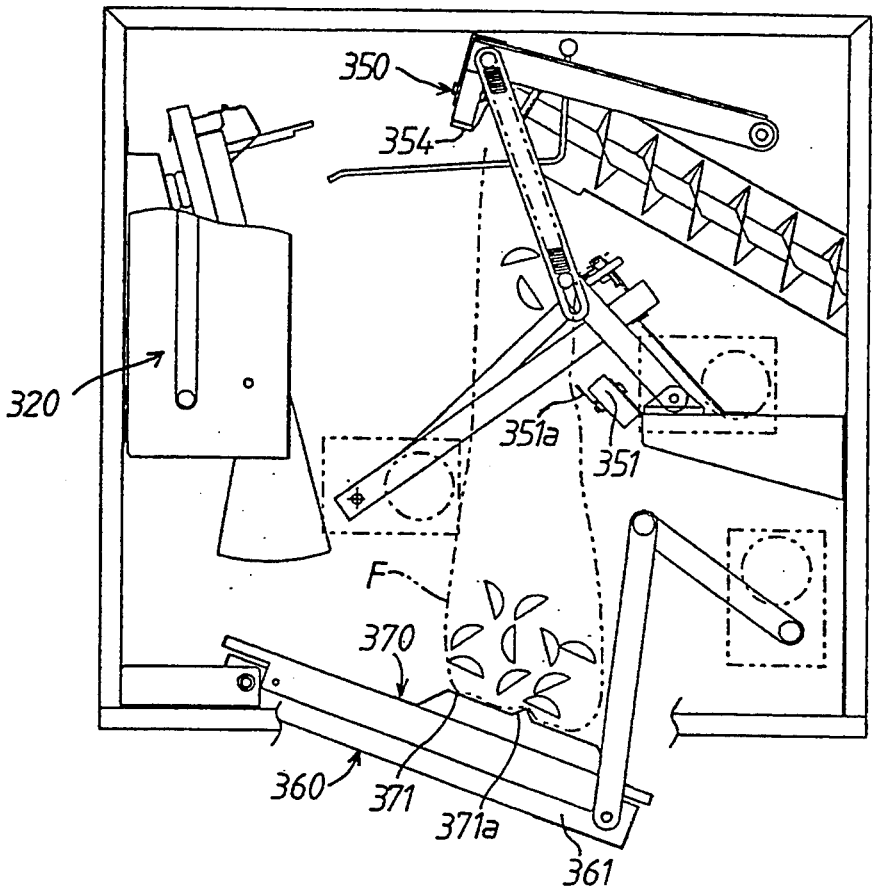
FIGS. 36 to 38 illustrate operational modes of the bagging apparatus shown in FIG. 35.
Figure 37:
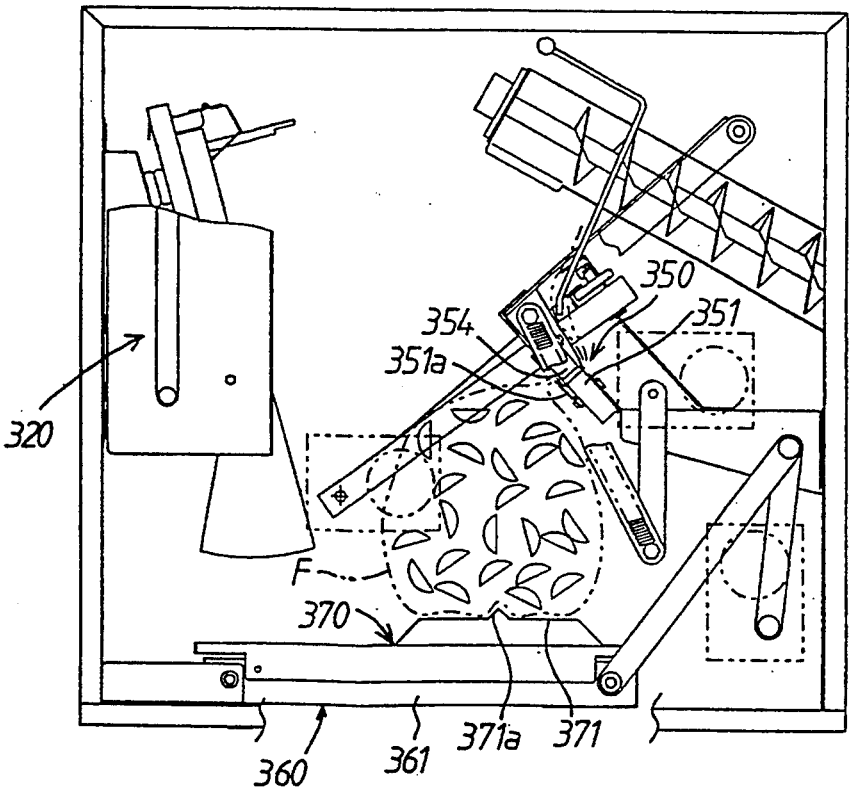
Figure 38:
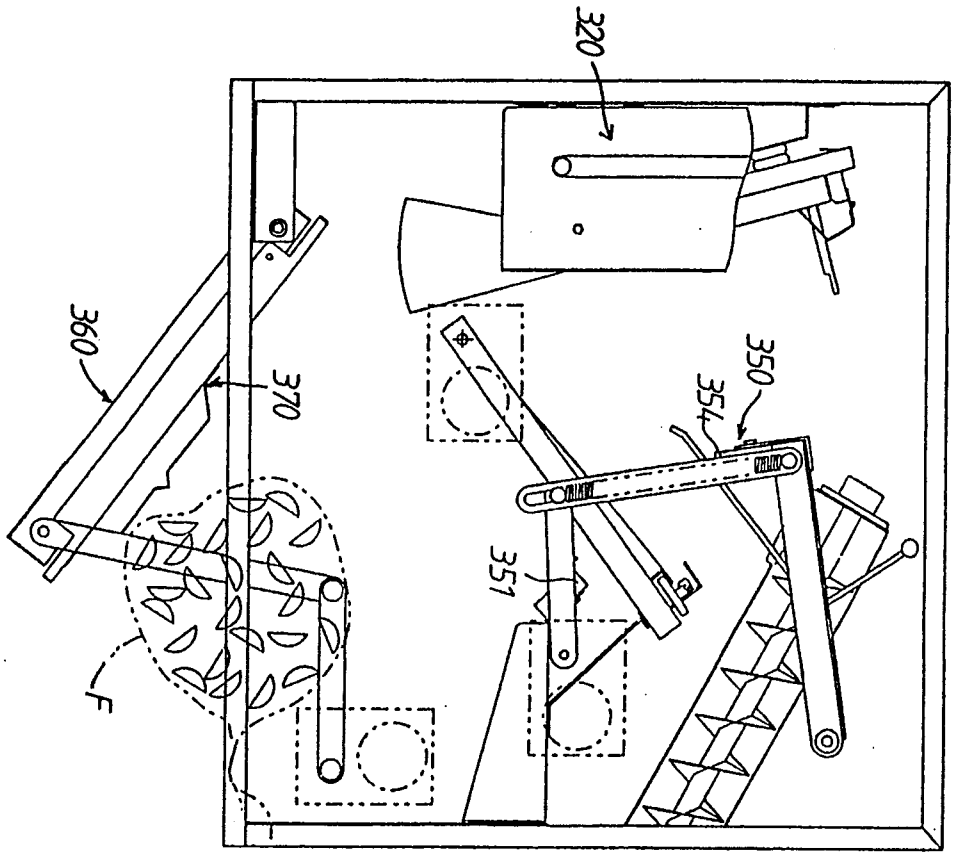
Figure 39A:
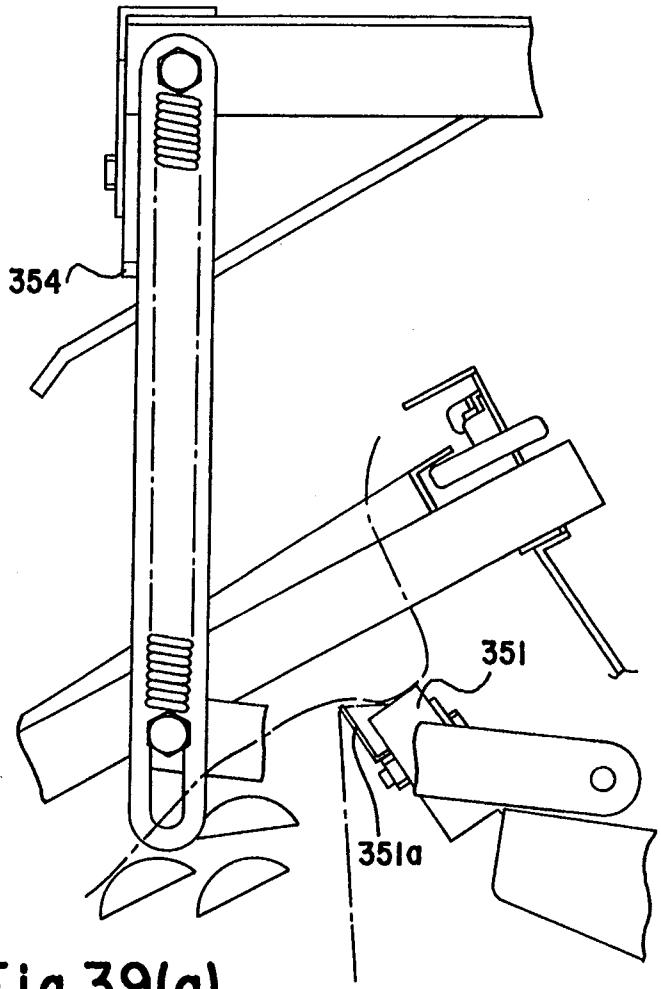
FIGS. 39(*a*) and 39(*b*) each are an enlarged side view of the bagging apparatus shown in FIG. 35.
Figure 39B:
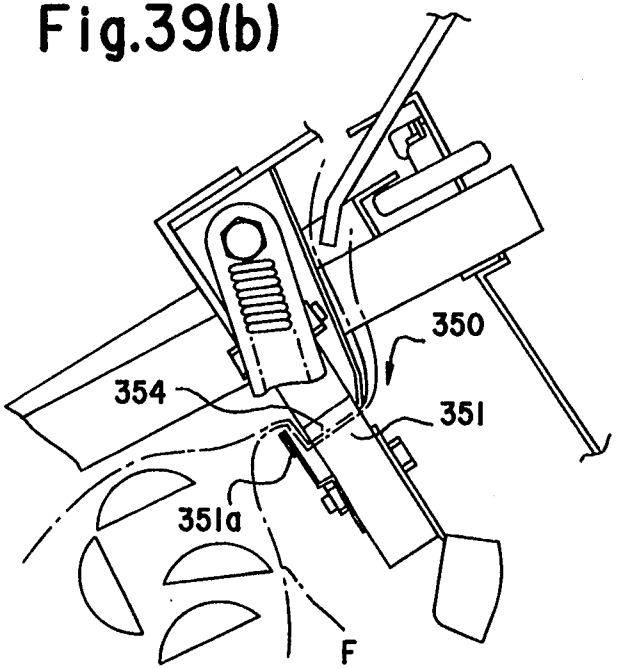

In FIG. 35, there is illustrated a modification of the bagging apparatus shown in FIG. 3. In this modified bagging apparatus Bb, a weight plate 324*a* is hinged to the upper end of a cartridge 324 in bag storage mechanism 320 for preventing two bags F from being picked up at a time as well as preventing the upper corners of each bag F from warping. The distal end of weight plate 324a is arranged to abut against the stored bags F until only the last bag F remains in the cartridge 324. A tilting mechanism 360 and a measuring mechanism 370 shown in FIG. 35 are desinged to have substantially the same construction as those in the bagging apparatuses described above. In the measuring mechanism 370, a receiving plate 371 is formed thereon with a lateral projection 371*a* for preventing slide movement of the bag F received thereon as shown in FIG. 36. When a base member 361 of the tiliting mechanism 360 has been retained in a horizontal direction as shown in FIG. 37, the bag F supplied with ice cubes is properly positioned in place to be sealed at its upper end portion. To more reliably position the bag F in place, it is desirable to form the lateral projection 371*a* on the receiving plate 371 at its right side in the figure. With such an arrangement of the lateral projection 371*a*, an angle of the base member 361 for dropping the sealed bag F can be made smaller than that in the first and second embodiments as shown in FIG. 38. This is useful to reduce the operation time of the tilting mechanism 360. A sealing mechanism 350 shown in FIG. 35 has substantially the same construction as those in the bagging apparatuses described above. In the sealing mechanism 350, a heater block 351 is provided with a separation plate 351*a* which is arranged to separate the sealed bag F from the heater block 351 when applied with the weight of the bagged ice cubes.

What is claimed is:

1. A bagging apparatus in combination with an ice making machine mounted thereon, comprising:

a frame structure provided thereon with the ice making machine:

a bag storage mechanism mounted on said frame structure to store a plurality of stacked bags each having a front portion and a rear attachment portion extending above the front portion, said bag storage mechanism including an upright support member mounted on said frame structure and provided with a plurality of laterally spaced parallel support pins on which the stacked bags are hung at their rear attachment portions to be successively taken out;

a bag feeding mechanism mounted on said frame structure at a position opposed to said bag storage mechanism and located below an ice delivery chute of said ice making machine, said bag feeding mechanism including an arch-shaped frame tiltably mounted on said frame structure to be moved toward and away from the stacked bags carried on said upright support member, means for moving said tiltable frame forwardly and backwardly, and clamping means mounted on an upper end portion of said tiltable frame for clamping the front portion of a foremost bag of the stacked bags when engaged therewith by forward movement of said tiltable frame and for pulling the front portion of the foremost bag when retracted by backward movement of said tiltable frame;

a bag support mechanism mounted on said frame structure at a position located between said upright support member and said tiltable frame, said bag support mechanism including a plurality of laterally spaced parallel support rods tiltably mounted on said frame structure and engageable with the parallel support pins of said upright support member and receiving the rear attachment portion of the foremost bag during backward movement of said tiltable frame, each of said parallel support rods being provided at an intermediate portion thereof with a retainer which is cooperable with said clamping means in backward movement of said tiltable frame for deploying an upper opening of the foremost bag at a position located below said ice delivery chute;

a sealing mechanism mounted on said frame structure to heat seal the upper opening of the foremost bag after a predetermined amount of ice cubes is supplied therein from said ice delivery chute; and support means tiltably mounted on said frame structure at a position located below said bag support mechanism to be retained in a horizontal position for receiving a bottom portion of the foremost bag thereon until the upper opening of the foremost bag is heat sealed and to be inclined downwardly for sliding the sealed bag of ice cubes into a cold storage bin arranged under said bagging apparatus, wherein said clamping means comprises a pair of laterally spaced stationary pawls secured to the upper end portion of said tiltable frame to be brought into contact with the front portion of said foremost bag in forward movement of said tiltable frame, a pair of spring loaded swingable levers pivoted to the upper end portion of said tiltable frame to be rotated in a forward direction when engaged at each first end thereof with the front portion of said foremost bag in forward movement of said tiltable frame and to be rotated in a reverse direction when engaged at each second end thereof with a stationary member mounted on said frame structure for support of a heater block of said sealing mechanism, and a pair of movable pawls integrally provided with said swingable levers to be engaged with said stationary pawls in response to forward rotation of said swingable levers for grasping the front portion of said foremost bag and to be disengaged from said stationary pawls in response to reverse rotation of said swingable levers for releasing the front portion of the foremost bag.

2. A bagging apparatus as claimed in claim 1, wherein said stationary pawls of said clamping means are arranged between said parallel support pins of said upright support member.

3. A bagging apparatus as claimed in claim 1, wherein said bag storage mechanism comprises an upright cassette mounted on said frame structure, and wherein said upright support member is in the form of a cartridge detachably assembled with said cassette, said cartridge being provided with said parallel support pins.

4. A bagging apparatus as claimed in claim 1, wherein said parallel support pins of said upright support member are respectively in the form of a hollow pin formed at a bottom side thereof with an axial slit to be engaged with said parallel support rods of said bag support mechanism.

5. A bagging apparatus as claimed in claim 1, wherein said parallel support rods of said bag support mechanism are maintained in engagement with said parallel support pins of said upright support member during forward movement of said tiltable frame of said bag feeding mechanism and tilted downwardly when the sealed bag of ice cubes slides into said cold storage bin.

6. A bagging apparatus as claimed in claim 1, wherein said support means comprises a base member tiltably mounted on said frame structure at a position located below said bag support mechanism to be retained in a downwardly inclined position at an initial stage when said foremost bag is supplied with ice cubes into said foremost bag; a receiving plate assembled with said base member for receiving the bottom portion of said foremost bag thereon and loaded upwardly by a spring mounted on said base member; weighing means disposed between said base member and said receiving plate; and means for lifting said base member to a horizontal position in accordance with supply of ice cubes into said foremost bag and for lowering said base member to the downwardly inclined position after the upper opening of said foremost bag is heat sealed.

7. A bagging apparatus in combination with an ice making machine mounted thereon, comprising:

a frame structure provided thereon with the ice making machine;

a bag storage mechanism mounted on said frame structure to store a plurality of stacked bags each having a front portion and a rear attachment portion extending above the front portion, said bag storage mechanism including an upright support member mounted on said frame structure and provided with a plurality of laterally spaced parallel support pins on which the stacked bags are hung at their rear attachment portions to be successively taken out;

a bag feeding mechanism mounted on said frame structure at a position opposed to said bag storage mechanism and located below an ice delivery chute of said ice making machine, said bag feeding mechanism including an arch-shaped frame tiltably mounted on said frame structure to be moved toward and away from the stacked bags carried on said upright support member, means for moving said tiltable frame forwardly and backwardly, and clamping means mounted on an upper end portion of said tiltable frame for clamping the front portion of a foremost bag of the stacked bags when engaged therewith by forward movement of said tiltable frame and for pulling the front portion of the foremost bag when retracted by backward movement of said tiltable frame;

a bag support mechanism mounted on said frame structure at a position located between said upright support member and said tiltable frame, said bag support mechanism including a plurality of laterally spaced parallel support rods tiltably mounted on said frame structure and engageable with the parallel support pins of said upright support member and receiving the rear attachment portion of the foremost bag during backward movement of said tiltable frame, each of said parallel support rods being provided at an intermediate portion thereof with a retainer which is cooperable with said clamping means in backward movement of said tiltable frame for deploying an upper opening of the foremost bag at a position located below said ice delivery chute;

a sealing mechanism mounted on said frame structure to heat seal the upper opening of the foremost bag after a predetermined amount of ice cubes is supplied therein from said ice delivery chute: and support means tiltably mounted on said frame structure at a position located below said bag support mechanism to be retained in horizontal position for receiving a bottom portion of the foremost bag thereon until the upper opening of the foremost bag is heat sealed and to be inclined downwardly for sliding the sealed bag of ice cubes into a cold storage bin arranged under said bagging apparatus, wherein said clamping means comprises an arch-shaped sub-frame tiltably assembled with said tiltable frame to be relatively moved thereto; an arch-shaped release lever tiltably assembled with said tiltable frame to be relatively moved thereto when engaged with a stationary member mounted on said frame structure for support of a heater block of said sealing mechanism; a pair of laterally spaced stationary pawls mounted on an upper end portion of said sub-frame to be brought into contact with the front portion of said foremost bag in forward movement of said tiltable frame; a pair of spring loaded swing-able levers pivoted to the upper end portion of said sub-frame to be rotated in a forward direction when pushed forwardly by engagement with the upper end portion of said tiltable frame at each first end thereof in forward movement of said tiltable frame and to be rotated in a reverse direction when engaged with said release lever at each second end thereof; and a pair of movable pawls integrally provided with said swingable levers to be engaged with said stationary pawls in response to forward rotation of said swingable levers for grasping the front portion of said foremost bag and to be disengaged from said stationary pawls in response to reverse rotation of said swingable levers for releasing the front portion of the foremost bag.

8. A bagging apparatus as claimed in claim 7, wherein said stationary pawls of said clamping means are arranged between said parallel support pins of said upright support member.

9. A bagging apparatus in combination with an ice making machine mounted thereon, comprising;

a frame structure provided thereon with the ice making machine;

a bag storage mechanism mounted on said frame structure to store a plurality of stacked bags each having a front portion and a rear attachment portion extending above the front portion, said bag storage mechanism including an upright support member mounted on said frame structure and provided with a plurality of laterally spaced parallel support pins on which the stacked bags are hung at their rear attachment portions to be successively taken out;

a bag feeding mechanism mounted on said frame structure at a position opposed to said bag storage mechanism and located below an ice delivery chute of said ice making machine, said bag feeding mechanism including a first movable member arranged to be moved toward and away from the stacked bags carried on said upright support member, means for moving said first movable member forwardly and backwardly, and clamping means mounted on said first movable member for clamping the front portion of a foremost bag of the stacked bags when engaged therewith by forward movement of said first movable member and for pulling the front portion of the foremost bag when retracted by backward movement of said first movable member;

a bag support mechanism mounted on said frame structure at a position located between said upright support member and said first movable member, said bag support mechanism including a plurality of laterally spaced parallel support rods tiltably mounted on said frame structure maintained in engagement with the parallel support pins of said upright support member during forward movement of said first movable member and receiving the rear attachment portion of the foremost bag during movement of said first movable member, said plurality of support rods being tilted downwardly when a sealed bag of ice cubes slides into a cold storage bin arranged under said bagging apparatus, each of said parallel support rods being provided at an intermediate portion thereof with a retainer which is cooperable with said clamping means in backward movement of said first movable member for deploying an upper opening of the foremost bag at a position located below said ice delivery chute;

a sealing mechanism mounted on said frame structure to heat seal the upper opening of the foremost bag after a predetermined amount of ice cubes is supplied therein from said ice delivery chute; and support means tiltably mounted on said frame structure at a position located below said bag support mechanism to be retained in a horizontal position for receiving a bottom portion of the foremost bag thereon until the upper opening of the foremost bag is heat sealed and to be inclined downwardly for sliding the sealed bag of ice cubes into the cold storage bin arranged under said bagging apparatus, wherein said clamping means comprises a second movable member assembled with said first movable member to be relatively moved thereto, a release member assembled with said first movable member to be relatively moved thereto when engaged with a stationary member mounted on said frame structure at a position located below said ice delivery chute; a pair of laterally spaced stationary pawls mounted on said second movable member to be brought into contact with the front portion of said foremost bag in forward movement of said first movable member; a pair of spring loaded swingable levers pivoted to said second movable member to be rotated in a forward direction when pushed forwardly by engagement with said first movable member at each first end thereof in forward movement of said first movable member and to be rotated in a reverse direction when engaged with said release member at each second end thereof; and a pair of movable pawls integrally provided with said swingable levers to be engaged with said stationary pawls in response to forward rotation of said swingable levers for grasping the front portion of said foremost bag and to be disengaged from said stationary pawls in response to reverse rotation of said swingable levers for releasing the front portion of said foremost bag.

10. A bagging apparatus as claimed in claim 9, wherein said stationary pawls of said clamping means are arranged between said parallel support pins of said upright support member.

11. A bagging apparatus as claimed in claim 9, wherein said support means comprises a base member tiltably mounted on said frame structure at a position located below said bag support mechanism to be retained in a downwardly inclined position at an initial stage when said foremost bag is supplied with ice cubes from said ice delivery chute and to be lifted at one end thereof during supply of ice cubes into said foremost bag; a receiving plate assembled with said base member for receiving the bottom portion of said foremost bag thereon and loaded upwardly by a spring mounted on said base member; weighing means disposed between said base member and said receiving plate; and means for lifting said base member to a horizontal position in accordance with supply of ice cubes into said foremost bag and for lowering said base member to the downwardly inclined position after the upper opening of said foremost bag is heat sealed.

12. A bagging apparatus as recited in claim 11, wherein said receiving plate of said support means is provided thereon with a recessed portion for holding the bottom portion of said foremost bag received thereon.

13. A bagging apparatus as recited in claim 11, wherein said receiving plate of said support means is provided thereon with a support plate of U shaped cross section for holding the bottom portion of said foremost bag received thereon and supporting said foremost bag upright.

* * * * *